US010439323B1

(12) United States Patent
Higgins

(10) Patent No.: US 10,439,323 B1
(45) **Date of Patent: *Oct. 8, 2019**

(54) HIGH VOLTAGE RF CONNECTOR FOR COAXIAL-TO-STRIPLINE TRANSITION

(71) Applicant: The United States of America, as represented by the Secretary of the Navy, Arlington, VA (US)

(72) Inventor: Shawn Orion Higgins, Ridgecrest, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/121,016

(22) Filed: Sep. 4, 2018

Related U.S. Application Data

(63) Continuation-in-part of application No. 15/722,740, filed on Oct. 2, 2017, now Pat. No. 10,096,955.

(51) Int. Cl.

| | |
|---|---|
| ***H01R 13/622*** | (2006.01) |
| ***H01R 13/502*** | (2006.01) |
| ***H01R 24/40*** | (2011.01) |
| *H01R 103/00* | (2006.01) |

(52) U.S. Cl.
CPC ..... *H01R 13/622* (2013.01); *H01R 13/502* (2013.01); *H01R 24/40* (2013.01); *H01R 2103/00* (2013.01)

(58) Field of Classification Search
CPC ..... H01R 13/622; H01R 9/0515; H01R 24/50
USPC ..... 439/581
See application file for complete search history.

(56) References Cited

U.S. PATENT DOCUMENTS

| | | | | |
|---|---|---|---|---|
| 3,854,789 | A * | 12/1974 | Kaplan | H01R 9/0521 439/584 |
| 4,374,606 | A | 2/1983 | Lathrop | |
| 4,690,482 | A | 9/1987 | Chamberland et al. | |
| 4,904,206 | A * | 2/1990 | Laudig | H01R 24/50 439/311 |
| 5,052,946 | A * | 10/1991 | Homolka | H01R 9/0521 439/427 |

(Continued)

OTHER PUBLICATIONS

Mantaro Product Development Services, Impledance Calculator, Website, 2016, Mantaro Networks Inc., United States http://www.mantaro.com/resources/impedance-calculator.htm.

(Continued)

*Primary Examiner* — Tulsidas C Patel
*Assistant Examiner* — Peter G Leigh
(74) *Attorney, Agent, or Firm* — Jimmy M. Sauz

(57) ABSTRACT

A high voltage RF connector for coaxial-to-stripline transition is capable of withstanding high voltages and providing impedance matching at RF frequencies. The high voltage RF connector comprises a bulkhead connector adapted to couple a coaxial cable connector. As the bulkhead connector matingly engages the coaxial cable connector, a first air gap forms therebetween, having an impedance determined, at least in part, by a first air gap distance between a first bulkhead connector dielectric insert and a coaxial cable connector dielectric insert. A second air gap also forms between first and second bulkhead connector dielectric inserts, both located within the bulkhead connector. The second air gap has approximately the same air gap distance and shape as the first air gap.

20 Claims, 15 Drawing Sheets

(56) References Cited

U.S. PATENT DOCUMENTS

| | | | | |
|---|---|---|---|---|
| 6,447,323 | B1 * | 9/2002 | Watanabe | H01R 4/70 174/84 R |
| 6,454,602 | B1 | 9/2002 | Sharrow | |
| 6,511,335 | B1 | 1/2003 | Rayssiguier et al. | |
| 6,884,115 | B2 * | 4/2005 | Malloy | H01R 9/0521 439/584 |
| 6,926,555 | B2 | 8/2005 | Nelson | |
| 8,221,161 | B2 * | 7/2012 | Leibfried, Jr. | H01R 13/6277 439/253 |
| 8,568,166 | B2 * | 10/2013 | Ryu | H01R 4/30 439/578 |
| 8,616,898 | B2 * | 12/2013 | Lee | H01R 24/50 439/63 |
| 9,608,343 | B2 | 3/2017 | Paynter et al. | |
| 2003/0092289 | A1 * | 5/2003 | Otsu | H01R 24/44 439/63 |
| 2013/0109228 | A1 * | 5/2013 | Sykes | H01R 9/0515 439/578 |

OTHER PUBLICATIONS

MICROWAVES101, Dual Dielectric Impedance Calculator, Website, 2016, MTT-S and IEEE, U.S. https://www.microwaves101.com/calculators/865-dual-dielectric-coax-calculator.

Mayer et al., Coaxial 30 kV Connectors for the RG220/U Cable: 20 Years of Operational Experience, Article, Mar./Apr. 2000, pp. 8-25, vol. 16, Issue: 2, IEEE, U.S.

Petter, Improved High Voltage Coax for Antiproton Source Kicker Pulse Forming Networks and Pulse Transmission, Fermi National Accelerator Laboratory; 1989, U.S.

Artusy et al., High Voltage Pulse Cable and Connector Experience in the Kicker Systems at SLAC, Article, May 1991, IAEA, U.S.

* cited by examiner

HIGH VOLTAGE RF CONNECTOR FOR COAXIAL-TO-STRIPLINE TRANSITION

CROSS-REFERENCE TO RELATED APPLICATIONS

This application is a continuation-in-part patent application of the commonly owned, U.S. non-provisional patent application Ser. No. 15/722,740, titled "High Voltage Radio Frequency Coaxial Cable Connector," filed on Oct. 2, 2017 by co-inventors Shawn Orion Higgins, Andrew K. Yuenger, and Stephen G. Hall, the contents of which is hereby expressly incorporated herein by reference in its entirety and to which priority is claimed.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD

The present disclosure relates generally to high voltage connectors, and more particularly, to high voltage radio frequency connectors for coupling and transitioning a coaxial cable to a bulkhead having a stripline transition to feed an antenna.

BACKGROUND

Coaxial cables may be used in various applications. Coaxial cables, for instance, may be used in high voltage applications, especially those involving high powered, radio frequency (RF) systems. These cables, however, need connectors that are reliable in order to handle and deliver relatively large amounts of power from high voltage power sources.

Coaxial cable connectors currently used for short pulsed RF systems generating more than 150 kV of peak voltage (i.e., 450 MW for 50Ω resistance), for instance, are generally unable to meet the demands of high voltage, power levels, and/or impedance matching requirements. As a result, connectors for these systems may be susceptible to electrical breakdown or voltage arcing due to its sharp edges, minimal dielectric strength, or other various mechanical design limitations such as crimp style connections at the backend of the connector. Other coaxial cable connectors such as those used for coupling a standard RG220 coaxial cable may even be unsuitable to withstand high voltages above 50 kV while providing maximum power transfer.

Accordingly, it is desirable to implement an RF connector that possesses high voltage standoff and impedance matching capabilities. Preferably, the new and improved high voltage coaxial cable connector is adapted to couple a coaxial cable to a bulkhead having a stripline transition.

SUMMARY OF ILLUSTRATIVE EMBODIMENTS

To minimize the limitations in the related art and other limitations that will become apparent upon reading and understanding the present specification, the following discloses embodiments of a new and useful high voltage connector for coaxial-to-stripline transition.

One embodiment may be a bulkhead connector for a coaxial-to-stripline transition, comprising: a bulkhead connector body having a flanged end, a threaded end, and a generally cylindrical cavity; and a first bulkhead connector dielectric insert snugly fitted within the generally cylindrical cavity of the bulkhead connector body and having a first end, a second end, and an axial bore adapted to house a center conductor, the first and second ends comprising: first and second mating faces, respectively, each having at least two circular grooves concentrically disposed with the axial bore; wherein the bulkhead connector may be adapted to mate with a coaxial cable connector having a coaxial cable connector dielectric insert comprising: one or more circular grooves and an axial bore, all concentrically disposed; and wherein as the bulkhead connector matingly engages the coaxial cable connector, the first mating face of the first end of the first bulkhead connector dielectric insert may at least partially overlie a mating face of the coaxial cable connector dielectric insert, thereby forming a first air gap therebetween, the first air gap having an impedance determined, at least in part, by a first air gap distance based on: (1) a length between the inner and outer diameters of the first bulkhead connector dielectric insert and (2) depths of the at least two first circular grooves of the first bulkhead connector dielectric insert and the one or more circular grooves of the coaxial cable connector. The bulkhead connector may further comprise: a second bulkhead connector dielectric insert comprising: one or more circular grooves and an axial bore, all concentrically disposed with one another and adapted to engage with the second end of the first bulkhead dielectric insert; wherein as the second bulkhead connector dielectric insert engages the second end of the first bulkhead connector dielectric insert, the second mating face of the first bulkhead connector dielectric insert may at least partially overlie a mating face of the second bulkhead connector dielectric insert, thereby forming a second air gap therebetween; and wherein the second air gap may have approximately the same air gap distance as the first air gap. The bulkhead connector may further comprise: a center conductor disposed within the axial bore of the first bulkhead connector dielectric insert, the center conductor comprising: a head and a stripline transition piece. The second bulkhead connector dielectric insert may comprise a flanged upper portion and a tapered bottom portion. The at least two circular grooves of first and second mating faces of the first bulkhead connector dielectric insert may be shaped substantially identical. The first bulkhead connector dielectric insert may further comprise an annular protrusion located within a sidewall of the axial bore; and wherein the transition piece may include a threaded bore and a neck portion adapted to threadably couple with the head of the center conductor to form an intermediate annular recess engaged with the annular protrusion. The first and second air gap distances may each be approximately 2.87 inches. The threaded end of the bulkhead connector body may comprise outer threads adapted to threadably engage with inner threads of a mating connector ring of the coaxial cable connector to prevent relative movement of the bulkhead connector and the coaxial cable connector, thereby maintaining the first air gap between the first bulkhead connector dielectric insert and the coaxial cable connector dielectric insert.

Another embodiment may be a bulkhead connector for a coaxial-to-stripline transition, comprising: a bulkhead connector body being generally cylindrical and having a flanged end, a threaded end, and a generally cylindrical cavity, the threaded end comprising outer threads and inner threads; a first bulkhead connector dielectric insert snugly fitted within the generally cylindrical cavity of the bulkhead connector body and comprising: a first end, a second end, and an axial bore adapted to house a center conductor, the first and second ends comprising: first and second mating faces, respectively, each having at least two circular grooves concentrically disposed with the axial bore; and a center conductor disposed within the axial bore of the first bulkhead connector dielectric insert; wherein the bulkhead connector may be adapted to mate with a coaxial cable connector, comprising: (1) a coaxial cable connector dielectric insert having one or more circular grooves and an axial bore, all concentrically disposed with one another on a mating face of the coaxial cable connector dielectric insert; and (2) a center conductor plug disposed within the axial bore of the coaxial connector dielectric insert; and wherein as the bulkhead connector matingly engages the coaxial cable connector, the first mating face located on the first end of the first bulkhead connector dielectric insert may at least partially overlie the mating face of the coaxial cable connector dielectric insert, thereby forming a first air gap therebetween, the first air gap having an impedance determined, at least in part, by a first air gap distance based on: (1) a length between the inner and outer diameters of the first bulkhead connector dielectric insert and (2) depths of the at least two circular grooves of the first bulkhead connector dielectric insert and the one or more circular grooves of the coaxial cable connector. The bulkhead connector may further comprise: a second bulkhead connector dielectric insert comprising: one or more circular grooves and an axial bore concentrically disposed within the one or more circular grooves, the second bulkhead connector dielectric insert being adapted to engage with the second end of the first bulkhead dielectric insert; wherein as the first bulkhead connector dielectric insert engages the second bulkhead connector dielectric insert, a second mating face of the first bulkhead connector dielectric insert may at least partially overlie a mating face of the second bulkhead connector dielectric insert, thereby forming a second air gap therebetween; and wherein the second air-gap may have approximately the same air gap distance as the first air gap. The first air gap and the second air gap may each have an air gap distance of approximately 2.87 inches. The bulkhead connector may further comprise: a center conductor disposed within the axial bore of the first bulkhead connector dielectric insert, the center conductor comprising: a head and a stripline transition piece; and wherein the stripline transition piece may feed to an antenna. The second bulkhead connector dielectric insert may comprise an upper flanged portion and a bottom tapered portion. The first bulkhead connector dielectric insert may further comprise an annular protrusion located within a sidewall of the axial bore; and wherein the transition piece may include a threaded bore and a neck portion adapted to threadably couple with the head of the center conductor to form an intermediate annular recess engaged with the annular protrusion. The at least two circular grooves of first and second mating faces of the first bulkhead connector dielectric insert may be shaped substantially identical. The bulkhead connector may further comprise a dielectric locking ring being generally cylindrical and having outer mating threads threadably engaged with the inner threads of the bulkhead connector body, the dielectric locking ring being adapted to abut against an annular shoulder of the first bulkhead connector dielectric insert, such that the first bulkhead connector dielectric insert is secured within the generally cylindrical cavity of the bulkhead connector body. The bulkhead connector may further comprise a mating connector ring adapted to contact and secure the coaxial cable connector and the bulkhead connector together to prevent relative movement and maintain the first air gap between the first bulkhead connector dielectric insert and the coaxial cable connector dielectric insert.

Another embodiment may be a bulkhead connector for a coaxial-to-stripline transition, comprising: a bulkhead connector body being generally cylindrical and having a threaded end, a flanged end, and a generally cylindrical cavity, the threaded end comprising outer threads and inner threads and the flange end comprising an outer flange and an annular protrusion; a first bulkhead connector dielectric insert snugly fitted within the generally cylindrical cavity of the bulkhead connector body and comprising: a first end, a second end, an axial bore, an annular shoulder contacting the annular protrusion of the bulkhead connector body, and an annular protrusion located within a sidewall of the axial bore, the first and second ends comprising: first and second mating faces, respectively, each having at least two circular grooves concentrically disposed with the axial bore and shaped substantially similar; a second bulkhead connector dielectric insert comprising: one or more circular grooves located on a mating face of the second bulkhead connector dielectric insert and an axial bore concentrically disposed within the one or more circular grooves, the second bulkhead connector dielectric insert being adapted to engage with the second end of the first bulkhead dielectric insert; a center conductor disposed within the axial bore of the bulkhead connector dielectric insert and comprising: a head and a stripline transition piece having a threaded bore and a neck portion, the neck portion being adapted to threadably couple with the head to form an intermediate annular recess engaged with the annular protrusion located within the sidewall of the second bulkhead connector dielectric insert; and a dielectric locking ring being generally cylindrical and having outer mating threads threadably engaged with the inner threads of the bulkhead connector body and an opening with a diameter fitted to allow the dielectric locking ring to abut against the at least one annular shoulder of the first bulkhead connector dielectric insert, such that the first bulkhead connector dielectric insert may be secured within the generally cylindrical cavity of the bulkhead connector body; wherein the bulkhead connector may be adapted to mate with a coaxial cable connector for electrically coupling a high voltage coaxial cable to a stripline transition, the coaxial cable connector comprising: a coaxial cable connector dielectric insert having: one or more circular grooves located on a mating face of the coaxial cable connector dielectric insert, an axial bore concentrically disposed within the one or more circular grooves of the coaxial cable connector dielectric insert, and an annular shoulder located on a sidewall of the axial bore; a center conductor plug adapted to engage with the head of the center conductor and disposed inside the axial bore of the coaxial connector dielectric insert; and a mating connector ring adapted to secure and prevent relative movement of the bulkhead connector and the coaxial cable connector; wherein as the bulkhead connector matingly engages the coaxial cable connector, the first mating face of the first bulkhead connector dielectric insert may at least partially overlie the mating face of the coaxial cable connector dielectric insert, thereby forming a first air gap therebetween, the first air gap having an impedance determined, at least in part, by a first air gap distance based on: (1) a length between the inner and outer diameters of the first bulkhead connector dielectric insert and (2) depths of the at least two circular grooves of the first bulkhead connector dielectric insert and the one or more circular grooves of the coaxial cable connector; and wherein as the second bulkhead connector dielectric insert engages the first bulkhead connector dielectric insert, the second mating face of the first bulkhead connector dielectric insert may at least partially overlie the mating face of the second bulkhead connector dielectric insert, thereby forming a second air gap therebetween, the second air gap having approximately the same air gap distance and shaped substantially identical as the first air gap. The second bulkhead connector dielectric insert may comprise an upper flanged portion and a bottom tapered portion. The first and second air gaps may each have an air gap distance of approximately 2.87 inches.

In one embodiment, the high voltage connector for coaxial-to-stripline transition may comprise a second air gap having an air gap distance of approximately 3.83 inches from the center conductor plug portion to the shield portion of the coaxial cable.

It is an object to provide a high voltage connector that couples and secures high voltage coaxial cables such as an RG220 coaxial cable to a bulkhead having a stripline transition. In an embodiment, the stripline transition may feed an antenna, such as an ultra-wideband antenna.

It is an object to provide a high voltage connector that may operate at high voltage levels at least above 50 kV.

It is an object to provide a high voltage electrical connector to be used in RF impulse systems operating at 200 kV and having an RF impedance of 50 ohms. The connector should have low voltage enhancements with emphasis on voltage breakdown and impedance matching.

It is an object to provide a high voltage connector that may operate at controlled RF frequencies in the range of 1 MHz to 5000 MHz.

It is an object to provide a high voltage connector capable of easy coupling of a coaxial cable to a bulkhead having a stripline transition and transmitting high voltages.

It is an object to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are illustrative embodiments. They do not illustrate all embodiments. They do not set forth all embodiments. Other embodiments may be used in addition or instead. Details, which may be apparent or unnecessary, may be omitted to save space or for more effective illustration. Some embodiments may be practiced with additional components or steps and/or without all of the components or steps, which are illustrated. When the same numeral appears in different drawings, it is intended to refer to the same or like components or steps.

FIGS. 2A and 28 are illustrations of assembled views of one embodiment of a high voltage RF coaxial cable connector and show the perspective and longitudinal views of the high voltage RF coaxial cable connector, respectively.

DETAILED DESCRIPTION OF ILLUSTRATIVE EMBODIMENTS

Figure 1:
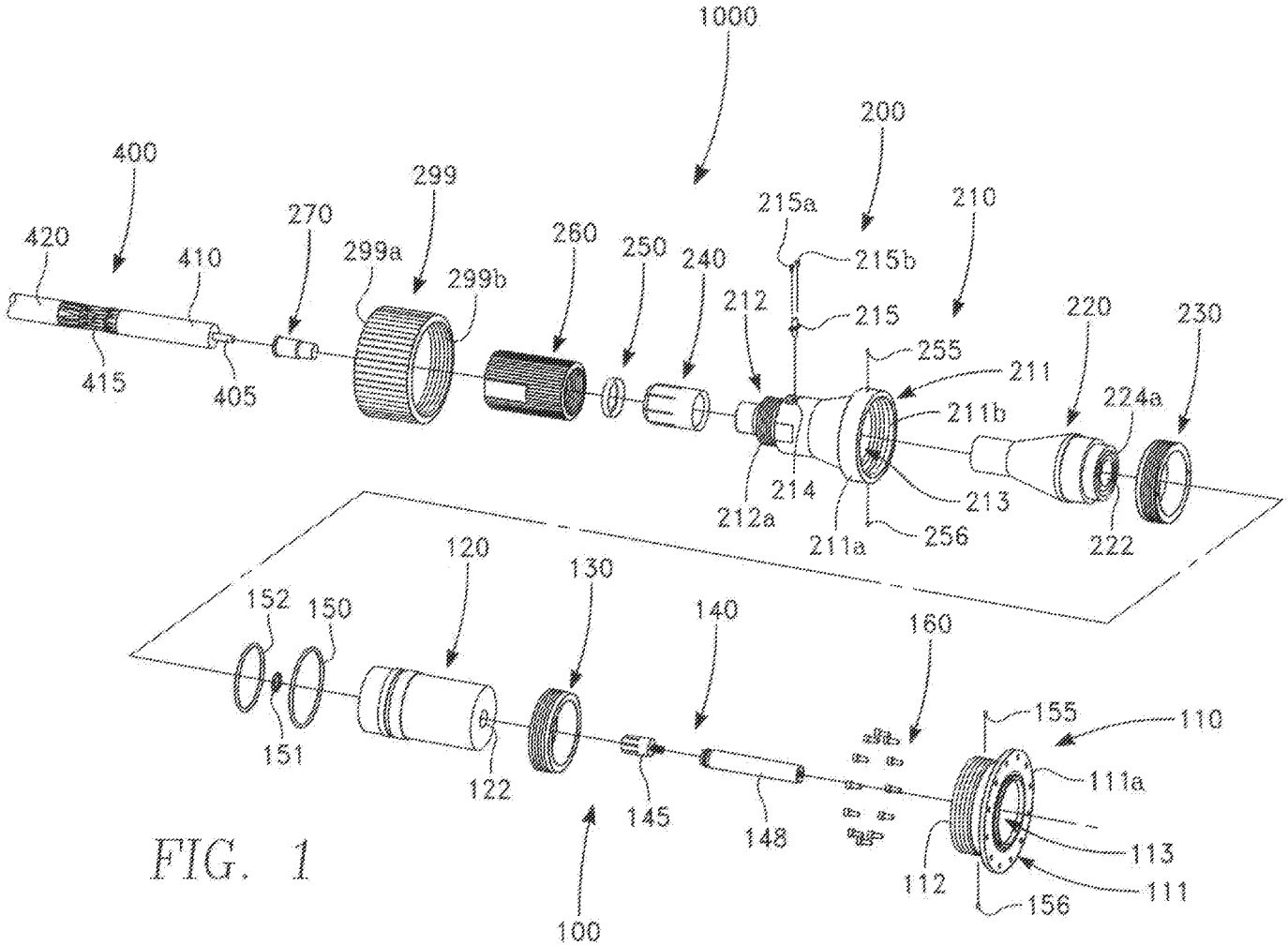
FIG. 1 is an illustration of an exploded, perspective view of one embodiment of a high voltage RF coaxial cable connector.

In the following detailed description, numerous specific details are set forth in order to provide a thorough understanding of various aspects of one or more embodiments of a high voltage RF connector for coaxial-to-stripline transition. However, these embodiments may be practiced without some or all of these specific details. In other instances, well-known methods, procedures, and/or components have not been described in detail so as not to unnecessarily obscure the aspects of these embodiments.

Before the embodiments are disclosed and described, it is to be understood that these embodiments are not limited to the particular structures, process steps, or materials disclosed herein, but is extended to equivalents thereof as would be recognized by those ordinarily skilled in the relevant arts. It should also be understood that terminology used herein is used for the purpose of describing particular embodiments only and is not intended to be limiting.

Reference throughout this specification to "one embodiment," "an embodiment," or "another embodiment" may mean that a particular feature, structure, or characteristic described in connection with the embodiment may be included in at least one embodiment of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in various embodiments. In the following description, numerous specific details are provided, such as examples of materials, fasteners, sizes, lengths, widths, shapes, etc . . . , to provide a thorough understanding of the embodiments. One skilled in the relevant art will recognize, however, that the scope of protection can be practiced without one or more of the specific details, or with other methods, components, materials, etc. . . . . In other instances, well-known structures, materials, or operations are generally not shown or described in detail to avoid obscuring aspects of the disclosure.

Definitions

In the following description, certain terminology is used to describe certain features of the embodiments of a high voltage coaxial to stripline transition. For example, as used herein, unless otherwise specified, the terms "conductor" refers to material through which electrons may flow, including without limitation, wires, cables, or other conductive media. The conductor may have an impedance, whether or not that impedance is known or can be determined.

As used herein, the term "coaxial cable" refers to any cable or interface having a substantially coaxial conductor or shield arrangement including, without limitation: RG-58/U, RG-59/U, RG-62/U, RG-62A, RG-174/U, RG-178/U RG-179/U, RG-213/U, RG-214, RG-217, RG-218, RG-220, and RG-223.

As used herein, the term "substantially" refers to the complete, or nearly complete, extent or degree of an action, characteristic, property, state, structure, item, or result. As an arbitrary example, an object that is "substantially" enclosed would mean that the object is either completely enclosed or nearly completely enclosed. The exact allowable degree of deviation from absolute completeness may in some cases depend on the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As another arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the terms "approximately" may refer to a range of values of ±10% of a specific value. For example, the expression "approximately 2.6 inches and 2.9 inches" may comprise the values from 2.34 inches to 3.19 inches. In other embodiments, the term "approximately" may also refer to a range of values of ±15% of a specific value.

As used herein, the term "about" is used to provide flexibility to a numerical range endpoint by providing that a given value may be "a little above" or "a little below" the endpoint. In some cases, the term "about" is to include a range of not more than a ½ inch of deviation. For example, the expression "about 2.87 inches" may comprise the values from 2.37 inches to 3.37 inches.

Distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5.

This same principle applies to ranges reciting only one numerical value and should apply regardless of the breadth of the range or the characteristics being described.

As used herein in this disclosure, the singular forms "a" and "the" may include plural referents, unless the context clearly dictates otherwise. Thus, for example, reference to a "flange screw" can include reference to one or more of such flange screws.

This disclosure relates generally to electrical connectors and, more particularly, to high voltage RF connectors capable of meeting the demands of high voltage and power levels. In particular, various short pulsed RF systems might utilize coaxial cables such as RG220 coaxial cables in order to carry high voltages, especially those above 200 kV. Transferring such high voltage and power levels for conventional coaxial cable connectors, however, is difficult. These connectors are generally unsuitable to withstand high voltages above 50 kV. Conventional coaxial cable connectors are also unable to provide maximum power transfer due to their susceptibility to electrical breakdown or voltage arcing. Such electrical breakdown may be caused by various mechanical design limitations such as the connector's sharp edges, minimal dielectric strength, and/or crimp style connections at the backend of the connector. The embodiments disclosed herein solve this problem by incorporating various structural changes in order to increase the dielectric strength and prevent voltage breakdown.

In its exemplary embodiments, the high voltage RF connector may be designed to couple a coaxial cable (e.g., RG220 coaxial cable) to a bulkhead and withstand high voltages while meeting impedance matching requirements. Specifically, these embodiments of the high voltage RF connector disclosed herein may withstand a maximum voltage of 215 kV of direct current (DC) RF impulse signals and may exceed the withstanding voltage or breakdown voltage of a standard RG220 coaxial cable. For example, in one embodiment, the high voltage RF connector may carry a DC signal having an impulse of 20 ns width with a center frequency response of approximately 25 MHz $$\left(\text{where: } f_c = \frac{1}{2\times 20\text{ ns}} = 25\text{ MHz}\right).$$

Here, the upper frequency spectrum band may also be determined based on the rise time of the impulse $$f_{2(upper\ frequency\ in\ 3\ dB)} = \frac{1.1}{\pi * \text{rise time}}.$$

A 1 GHz 3 dB upper frequency spectrum limit, for instance, may be created by a 350 ps rise time signal. Alternatively, a 5 GHz 3 dB upper frequency spectrum limit may be created by a 70 ps rise time signal.

Embodiments of the high voltage RF connector may also be suitable to transfer AC signals as well between approximately 1 MHz to 5000 MHz (and potentially higher determined by acceptable insertion loss/reflection).

Embodiments of the high voltage RF connector may also have an RF impedance of 50 ohms based on the dielectric constant of the material for the frequency range considered.

In various embodiments, the high voltage RF connector may have an impedance continuity that transitions from approximately 50 ohms to 93 ohms and may taper from 93 ohms back to the 50 ohms of the coaxial cable. In order to assist with high voltage breakdown, embodiments of the high voltage RF connector may be designed with lowered field excitations by filleting edges of certain parts of the connector.

Advantages of the high voltage RF connector disclosed herein may lie within the geometry of the dielectric inserts and coaxial cable connector dielectric insert. The dielectric inserts, including the first and second bulkhead connector dielectric inserts and the coaxial cable connector dielectric insert. These dielectric inserts may mate and create air gaps sufficient to withstand high voltages and protect against field strengths of 200 kV. Thus, embodiments of the high voltage RF connector may be designed for coaxial-to-stripline transition and may have high breakdown voltage and impedance matching characteristics.

FIG. 1 is an illustration of an exploded, perspective view of one embodiment of a high voltage RF coaxial cable connector. As shown in FIG. 1, one embodiment of the high voltage connector assembly 1000 may comprise a bulkhead connector 100 and a coaxial cable connector 200.

The bulkhead connector 100 may be connector that is mounted onto a bulkhead to provide ease of connection and disconnection of a coaxial cable to and from the bulkhead. One embodiment of the bulkhead connector 100 may comprise: a bulkhead connector body 110 with set screws 155, 156, a bulkhead connector dielectric insert 120, a first dielectric locking ring 130, a center conductor 140 having a head 145 and a cylindrical body 148, O-rings 150, 151, 152, and flange screws 160.

In one embodiment, the bulkhead connector body 110 may be a metallic shell that houses various components of the bulkhead connector 100 and may have a flanged end 111, a threaded end 112 and a cavity 113. The flanged end 111 may have an outer flange 111*a* such as an external rim or lip, for mounting or attaching the bulkhead connector 100 to another object such as a bulkhead via the flange screws 160. The threaded end 112 of the bulkhead connector body 110 may be used to threadably engage and secure the coaxial cable connector 200 to the bulkhead connector 100.

The bulkhead connector dielectric insert 120 may be unitary body constructed of dielectric material that is tabularly structured with an axial bore 122, extending therethrough. In various embodiments, the bulkhead connector dielectric insert 120 may be constructed of a synthetic resin such as Teflon® and may be press inserted into the bulkhead connector body 110. The bulkhead connector dielectric insert 120 may also resiliently accept the center conductor 140 and may electrically insulate the center conductor 140, such that the center conductor is electrically isolated from the bulkhead connector body 110. The bulkhead connector dielectric insert 120 may be disposed within the generally cylindrical cavity 113 of the bulkhead connector body 110. The bulkhead connector dielectric insert 120 may also comprise circular grooves 124*a*, 124*b* (shown in FIG. 11) and an axial bore 122 for housing or securing the center conductor 140. The circular grooves 124*a*, 124*b* and center conductor 140 may be adapted to mate and engage with the coaxial cable connector dielectric insert 220 and center conductor plug 270 of the coaxial cable connector 200.

In order to secure the bulkhead connector dielectric insert 120 within the cavity 113 of the bulkhead connector body 110, the first dielectric locking ring 130 may threadably engage within the cavity 113 of the threaded end 112 of the bulkhead connector body 110. In this manner, a portion of the bulkhead connector dielectric insert 120 may be secured between the first dielectric locking ring 130 and the bulkhead connector body 110. Additionally, set screws 155, 156 may be used to retain the first dielectric locking ring 130 within the cavity 113 of the bulkhead connector body 110.

As discussed above, the center conductor 140 may be disposed within the axial bore 122 of the bulkhead connector dielectric insert 120 and may allow electrical current to flow. The center conductor 140 may provide a termination for an end of the coaxial cable 400 and may comprise: a head 145 and a cylindrical body 148, wherein the head 145 may comprise a receptacle portion adapted to engage with the center conductor plug 270 of the coaxial cable connector 200. In various embodiments, the O-rings 150, 151, 152 may be used to hermetically seal the bulkhead connector 100, from oil or gas-filled environments.

FIG. 1 shows that the high voltage RF coaxial cable connector 1000 may also comprise a coaxial cable connector 200. The coaxial cable connector 200 may house a coaxial cable 400 such as a high voltage RF coaxial cable (e.g., RG-220) and may be adapted to releasably couple to the bulkhead connector IOU. In this manner, the coaxial cable 400 may be easily connected or disconnected to/from the bulkhead. One embodiment of the coaxial cable connector 200 may comprise: a coaxial cable connector body 210 with set screws 255, 256, a capacitive differential probe 215 with screws 215*a*, 215*b*, a coaxial cable connector dielectric insert 220, a second dielectric locking ring 230, a shield compress retainer 240, a shield compress ring 250, a jacket cover 260, a center conductor plug 270, and a mating connector ring 299.

FIG. 1 shows that the coaxial cable connector body 210 may have a generally tapered body with a base end 211, a tapered end 212 and a cavity 213. The base end 211 may have a protruding circular rim portion 211*a* adapted to be flushed against the sidewall of the mating connector ring 299. The base end 211 may also have inner threads 211*b* adapted to threadably engage with the bulkhead connector body 110. The tapered end 212 of the coaxial connector body 210 may comprise outer threads 212*a* for threadably engaging the jacket cover 260. Within the jacket cover 260, a shield compress retainer 240 and a shield compress ring 250 may be used to help retain and secure the coaxial connector 200 to a coaxial cable 400. Details as to how the shield compress retainer 240, shield compress ring 250, and jacket cover 260 engage with the tapered end 212 of the coaxial cable connector body 210 are explained in further detail below.

The coaxial cable connector dielectric insert 220 may be a unitary body constructed of dielectric material with a structure that is generally tapered and having an axial bore 222, extending therethrough. The coaxial cable connector dielectric insert 220 may be used to help electrically insulate the coaxial cable 400 and may be disposed within the generally cylindrical cavity 213 of the coaxial cable connector body 210. The coaxial cable connector dielectric insert 220 may also comprise circular grooves 224*a*, 224*b*, 224*c* and an axial bore 222 that resiliently receives the coaxial cable 400. In preferred embodiments, the coaxial cable connector dielectric insert 220 may be adapted to mate and engage with the mating face 124 of the bulkhead connector dielectric insert 120, such that the circular grooves 224*a*, 224*b*, 224*c* of the coaxial cable connector dielectric insert 220 may be fitted and concentrically disposed with the circular grooves 124*a*, 124*b* of the bulkhead connector 100.

The coaxial cable connector dielectric insert 220 may be retained and secured within the coaxial cable connector body 210 via the second dielectric locking ring 230, which may threadably engage with the coaxial cable connector body 210. Like the first dielectric locking ring 130, the second dielectric locking ring 230 may be threadably engaged within the coaxial cable connector body 210, such that a portion of the coaxial cable connector dielectric insert 220 may be positioned between the second dielectric locking ring 230 and the coaxial cable connector body 210. Set screws 255, 256 may also be used retain and secure the second dielectric locking ring 230 within the cavity 213 of the coaxial cable connector body 210.

The center conductor plug 270 may couple to the conductor portion 405 of the coaxial cable 400 and may be adapted to engage with the head 145 of the center conductor 140. In one embodiment, the center conductor plug 270 may couple to the conductor portion 405 of the coaxial cable 400 via soldering. In another embodiment, the center conductor plug 270 may couple to the conductor portion 405 of the coaxial cable 400 via one or more set screws.

In addition to the center conductor portion 405, FIG. 1 shows that the coaxial cable 400 may comprise a dielectric portion 410, shield portion 415, and an insulation portion 420. The dielectric portion 410 may be disposed between the center conductor portion 405 and the shield portion 415, and the center connector plug 270 and coaxial cable 400 may be situated within the axial bore 222 of the coaxial connector dielectric insert 220. The shield portion 415 may be a metal braid covered by the insulation portion 420, which may be an outer cylindrical plastic jacket.

When the bulkhead connector 100 mates and engages with the coaxial cable connector 200, the mating connector ring 299 may secure the coaxial cable connector 200 to the bulkhead connector 100. Specifically, the mating connector ring 299 may have an annular protrusion 299*a* that engages the circular rim portion 211*a* of the base end 211 of said coaxial connector body 210, such that the circular rim portion 211*a* is flushed against the annular protrusion 299*a* of the mating connector ring 299. The inner threads 299*b* of the mating connector ring 299 may also engage with the threaded end 112 of the bulkhead connector body 110 in order to hold and secure the coaxial cable connector 200 to the bulkhead connector 100.

Finally, FIG. 1 shows a capacitive differential probe 215 adapted to couple with the voltage monitor test point 214. The capacitive differential probe 215 may utilize capacitive properties to deliver a low voltage port for monitoring an RF signal carried through the high voltage RF coaxial cable connector 1000 without affecting signal integrity. Thus, by contacting the coaxial cable connector dielectric insert 220, the center conductor of the capacitive differential probe 215 may be used to determine the capacitance of the probe simply by measuring the effective area of the center conductor of the capacitive differential probe 215. This effective area may also be used to find the scale factor of the electric field passing through the high voltage RF coaxial cable connector 1000. In order to provide accurate measurements of voltage signals, some embodiments of the coaxial cable connector 200 may have the voltage monitor test point 214 positioned at a location closest to the center conductor of the coaxial cable 400, which may be near the tapered end 212 of the coaxial cable connector 200.

Figure 2A:
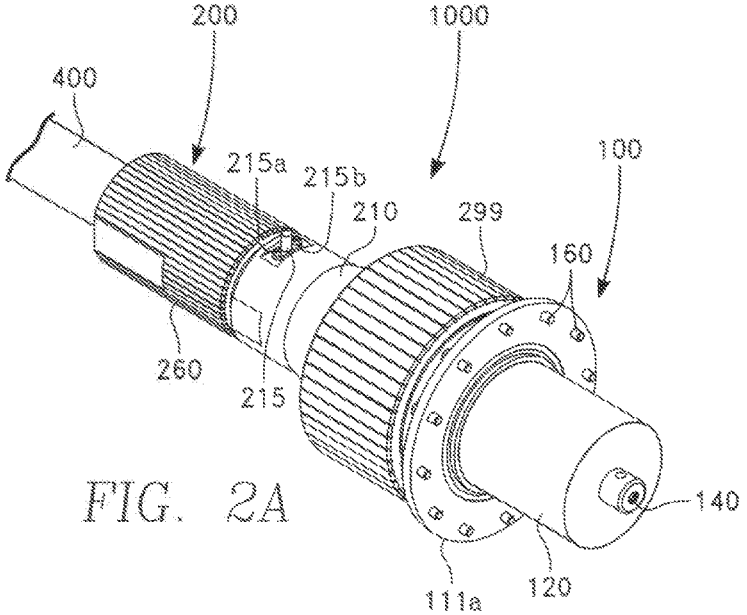
Figure 2B:
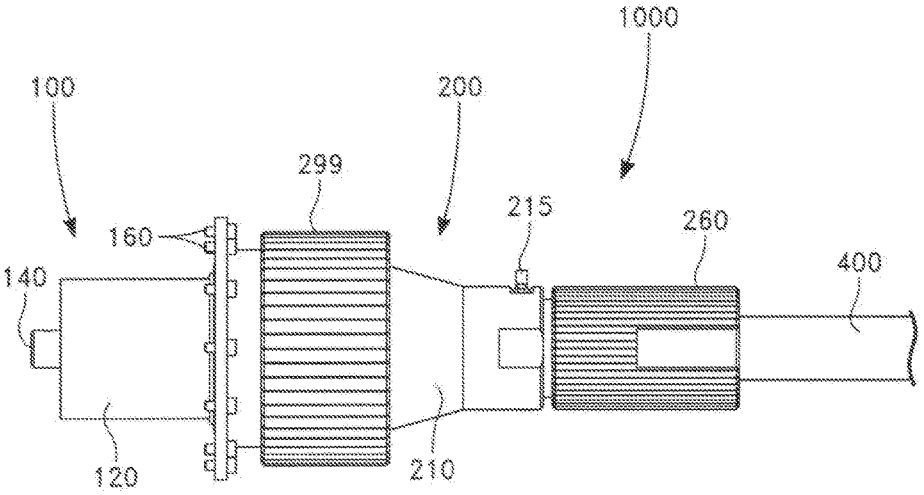

FIGS. 2A and 2B are illustrations of assembled views of one embodiment of a high voltage RF coaxial cable connector and show the perspective and longitudinal views of the high voltage RF coaxial cable connector, respectively. As shown in FIGS. 2A and 2B, one embodiment of the high voltage RF coaxial cable connector 1000 may comprise a bulkhead connector 100 mated with a coaxial cable connector 200. Importantly, FIGS. 2A and 2B show how the mating connector ring 299 couples to the base end 211 of the coaxial cable connector body 210 with the bulkhead connector body 110. In particular, the circular rim portion 211*a* may be flushed against the annular protrusion 299*a* of the mating connector ring 299, such that one end of the mating connector ring 299 is engaged the circular rim portion 211*a* of the base end 211 of the coaxial cable connector body 210. The other end of the mating connector ring 299 may be threadably engaged with the outer threads 112*a* of the bulkhead connector body 110.

FIGS. 2A and 213 show that the flange screws 160 may be coupled to the outer flange 111*a* of the bulkhead connector body 110 for mounting the bulkhead connector body 110 onto a surface such as a bulkhead. The bulkhead connector dielectric insert 120 may be positioned within the cavity 113 of the bulkhead connector body 110 and may be exposed when the bulkhead connector 100 is assembled. FIGS. 2A and 2B also show that the center conductor 140 may be secured within the axial bore 122 of the bulkhead connector dielectric insert 120.

Figure 3:
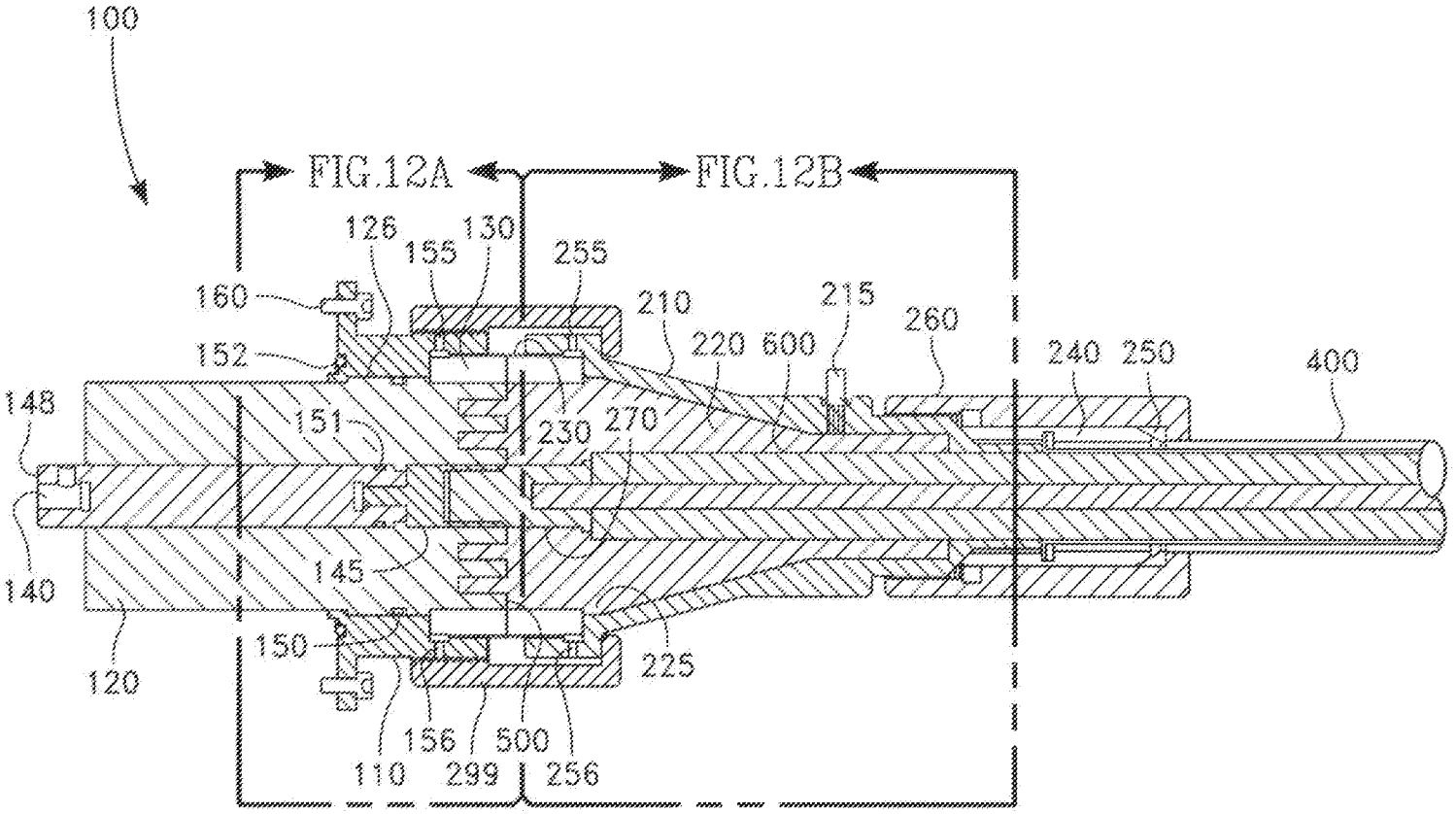
FIG. 3 is an illustration of an assembled, cross section view of one embodiment of a high voltage RF coaxial cable connector.

FIG. 3 is an illustration of an assembled, cross section view of one embodiment of a high voltage RF coaxial cable connector. As shown in FIG. 3, one embodiment of the high voltage RF coaxial cable connector 1000 may comprise a bulkhead connector 100 and a coaxial cable connector 200. The bulkhead connector 100 may comprise: a bulkhead connector body 110 with set screws 155, 156, a bulkhead connector dielectric insert 120, a first dielectric locking ring 130, a center conductor 140 having a head 145 and a cylindrical body 148, O-rings 150, 151, 152, and flange screws 160. The coaxial cable connector 200, which may house a portion of a coaxial cable 400, may comprise: a coaxial cable connector body 210 with set screws 255, 256, a capacitive differential probe 215, a coaxial cable connector dielectric insert 220, a second dielectric locking ring 230, a shield compress retainer 240, a shield compress ring 250, a jacket cover 260, a center conductor plug 270, and a mating connector ring 299.

FIG. 3 shows that the bulkhead connector 100 may mate and engage with the coaxial cable connector 200, such that the mating face 124 (shown in FIG. 11) of the bulkhead connector dielectric insert 120 may overlie the mating face 224 (shown in FIG. 10) of the coaxial cable connector dielectric insert 220. In this manner, a first air gap 500 (shown in FIG. 12A) may be formed in-between the bulkhead connector dielectric insert 120 and the coaxial cable connector dielectric insert 220 to thereby provide an impedance matching compensation. Importantly, the impedance of the first air gap 500 may be determined by a first air gap distance 501 based on: (1) a length between the inner and outer diameters of the bulkhead connector dielectric insert 120 and coaxial cable connector dielectric insert 220 and (2) depths of the two circular grooves 124*a*, 124*b* of the bulkhead connector dielectric insert 120 and circular grooves 224*a*, 224*b*, 224*c* of the coaxial cable connector dielectric insert 220. Details of the first air gap 500 are described in more detail below in FIG. 12A.

Within the coaxial cable connector 200, a second air gap 600 (shown in FIG. 12B) may also form between the center conductor plug 270 and the said shield portion 415 of the coaxial cable 400. Like the first air gap 500, the impedance of the second air gap 600 may be determined by a second air gap distance 601, which may be approximately the same length as the first air gap 500. Details of the second air gap 600 are described in more detail below in FIG. 12B.

In one embodiment, the center conductor 140 of the bulkhead connector 100 may have a diameter that is approximately ¾ inches. The cylindrical body 148 of the center conductor 140 may also have an internal thread adapted to engage with the head 145. A neck portion 149 of the cylindrical body 148 may also function as an intermediate annular recess for securing the center conductor 140 within the bulkhead connector dielectric insert 120. Annular edges of the internal thread of the center conductor 140 may also be rounded or filleted in order to help reduce voltage enhancement.

Regarding the dielectric locking rings, as discussed above, the first dielectric locking ring 130 may be used to hold and retain the bulkhead connector dielectric insert 120 within the bulkhead connector 100. This may be accomplished by having the first dielectric locking ring 130 abut against the annular shoulder 126 of the bulkhead connector dielectric insert 120. In particular, when the bulkhead connector dielectric insert 120 is situated within the cavity 113 of the bulkhead connector 100, the first dielectric locking ring 130 may threadably engage with the bulkhead connector 100 and abut against the annular shoulder 126 of the bulkhead connector dielectric insert 120.

Similarly, the second dielectric locking ring 230 may retain the coaxial cable connector dielectric insert 220 within the cavity 213 of the coaxial cable connector 200. This may be accomplished by having the second dielectric locking ring 230 abut against the annular shoulder 225 of the coaxial cable connector dielectric insert 220 when the coaxial cable connector dielectric insert 220 is situated within the cavity 213 of the coaxial cable connector 200. In particular, when the coaxial cable connector dielectric insert 220 is situated within the cavity 213 of the coaxial cable connector 200, the second dielectric locking ring 230 may threadably engage with the coaxial cable connector 200 and abut against the annular shoulder 225 of the coaxial cable connector dielectric insert 220. In order to further secure and retain the first dielectric locking ring 130 and second dielectric locking ring 230, various embodiments may utilize set screws 155, 156, 255, 256.

Figure 4:
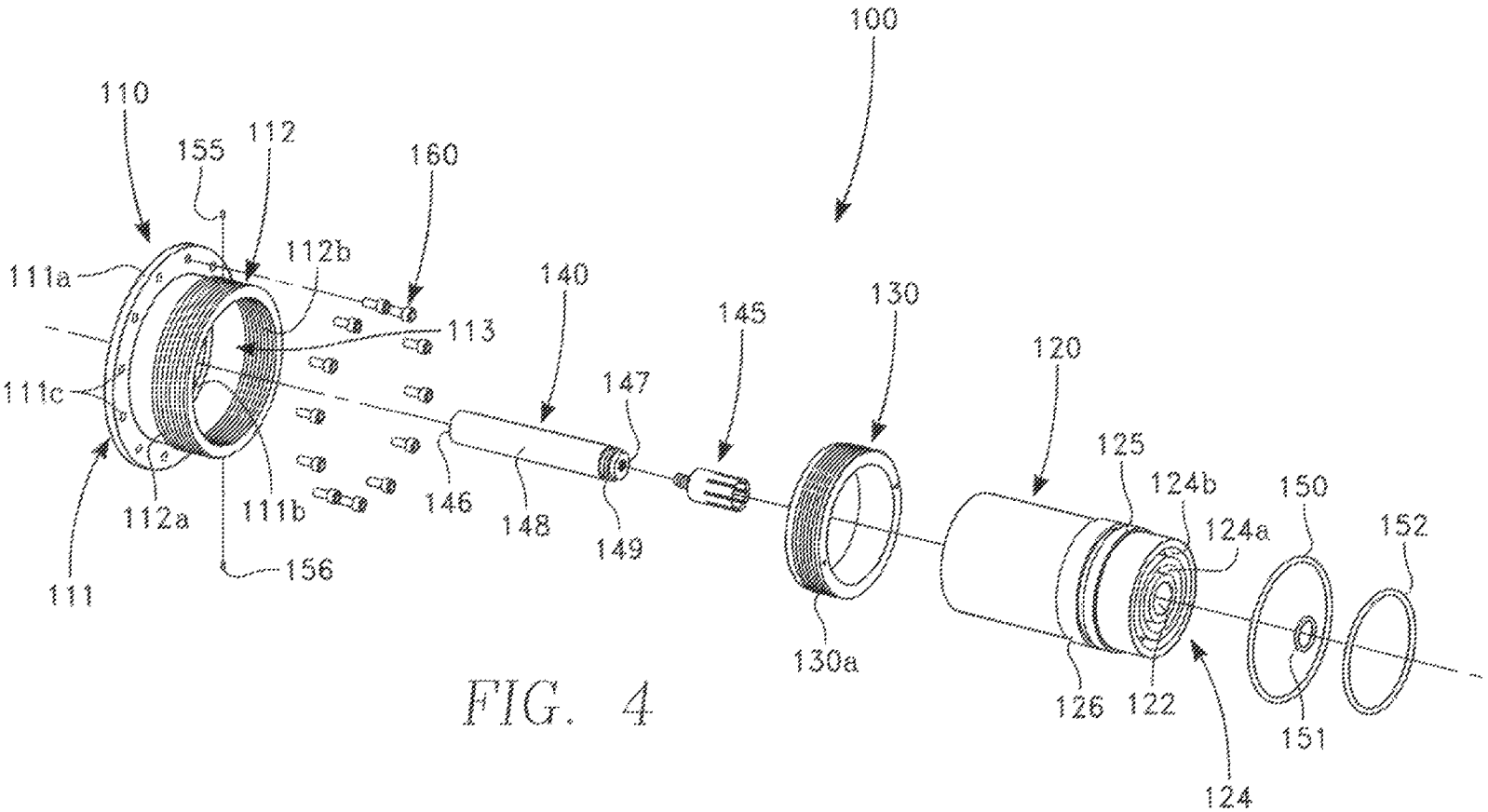
FIG. 4 is an illustration of an exploded, perspective view of one embodiment of a bulkhead connector and shows the bulkhead connector in greater detail.

FIG. 4 is an illustration of an exploded, perspective view of one embodiment of a bulkhead connector and shows the bulkhead connector in greater detail. As shown in FIG. 4, the bulkhead connector 100 may comprise a bulkhead connector body 110, which may be generally cylindrical and may have a flanged end 111, a threaded end 112 and a cavity 113, which may be generally cylindrical. The flanged end 111 of the bulkhead connector 100 may comprise an outer flange 111*a* be an external rim or lip for mounting or attachment of the bulkhead connector 100 to another object such as a bulkhead. The flanged end 111 may also comprise an annular protrusion 111*b*. The outer flange 111*a* may comprise fastener holes 111*c* for coupling the outer flange 111*a* to the bulkhead via flange screws 160. The annular protrusion 111*b* may be used to restrict longitudinal movement of the bulkhead connector dielectric insert 120 when the bulkhead connector dielectric insert 120 moves or traverses through the cavity 113 of the bulkhead connector body 110.

On the other hand, the threaded end 112 of the bulkhead connector body 110 may be used to threadably engage and secure the bulkhead connector 100 to the coaxial cable connector 200. Specifically, the threaded end 112 of the bulkhead connector body 110 may comprise outer threads 112*a* and inner threads 1126. The outer threads 112*a* may threadably engage with the inner mating threads 299*a* of the mating connector ring 299. In this manner, the outer threads 112*a* may help secure the base end 211 of the coaxial connector body 210 and prevent relative movement of the bulkhead connector 100 and the coaxial cable connector 200. This may also help maintain the shape and size of the air gap 500 formed between the bulkhead connector dielectric insert 120 and the coaxial cable connector dielectric insert 220.

As discussed above, the threaded end 112 of the bulkhead connector body 110 may also be used to secure the bulkhead connector dielectric insert 120 to the bulkhead connector body 110. This may be achieved by threadably engaging the first dielectric locking ring 130 within the bulkhead connector body 110. Specifically, the first dielectric locking ring 130 may comprise outer mating threads 130*a* adapted to threadably engaged with the inner threads 1126 of the bulkhead connector body 110. The first dielectric locking ring 130 may also have a diameter fitted to allow the first dielectric locking ring 130 to abut against the annular shoulder 126 of the bulkhead connector dielectric insert 120. Thus, when the bulkhead connector dielectric insert 120 is placed within the generally cylindrical cavity 113 of the bulkhead connector body 110, the annular shoulder 126 of the bulkhead connector dielectric insert 120 may abut against the annular protrusion 111*b* of the bulkhead connector body 110. In this manner, the first dielectric locking ring 130 may therefore secure the bulkhead connector dielectric insert 120 by threadably engaging the outer mating threads 130*a* of the first dielectric locking ring 130 with the inner threads 1126 of the bulkhead connector body 110 in order for the first dielectric locking ring 130 to abut against the annular shoulder 125 of the bulkhead connector dielectric insert 120.

As discussed above, the bulkhead connector dielectric insert 120 may be fitted within the generally cylindrical cavity 113 of the bulkhead connector body 110 and may comprise an annular shoulder 126 that abuts against the annular protrusion 1116 of the bulkhead connector body 110. The bulkhead connector dielectric insert 120 may also comprise two circular grooves 124*a*, 1246 and an axial bore 122. The two circular grooves 124*a*, 124*b* may be concentrically disposed with one another on a mating face 124 of the bulkhead connector dielectric insert 120, and the axial bore 124 may be centered on a longitudinal axis of the bulkhead connector dielectric insert 120. The axial bore 124 and the two circular grooves 124*a*, 124*b* may be concentrically disposed with each other. Within the sidewall of the axial bore 122, an annular lip 122*a* (shown in FIG. 6) may bite into center conductor 140 to thereby retain the secure the center conductor 140 within the axial bore 122.

Figures 15A, 15B:
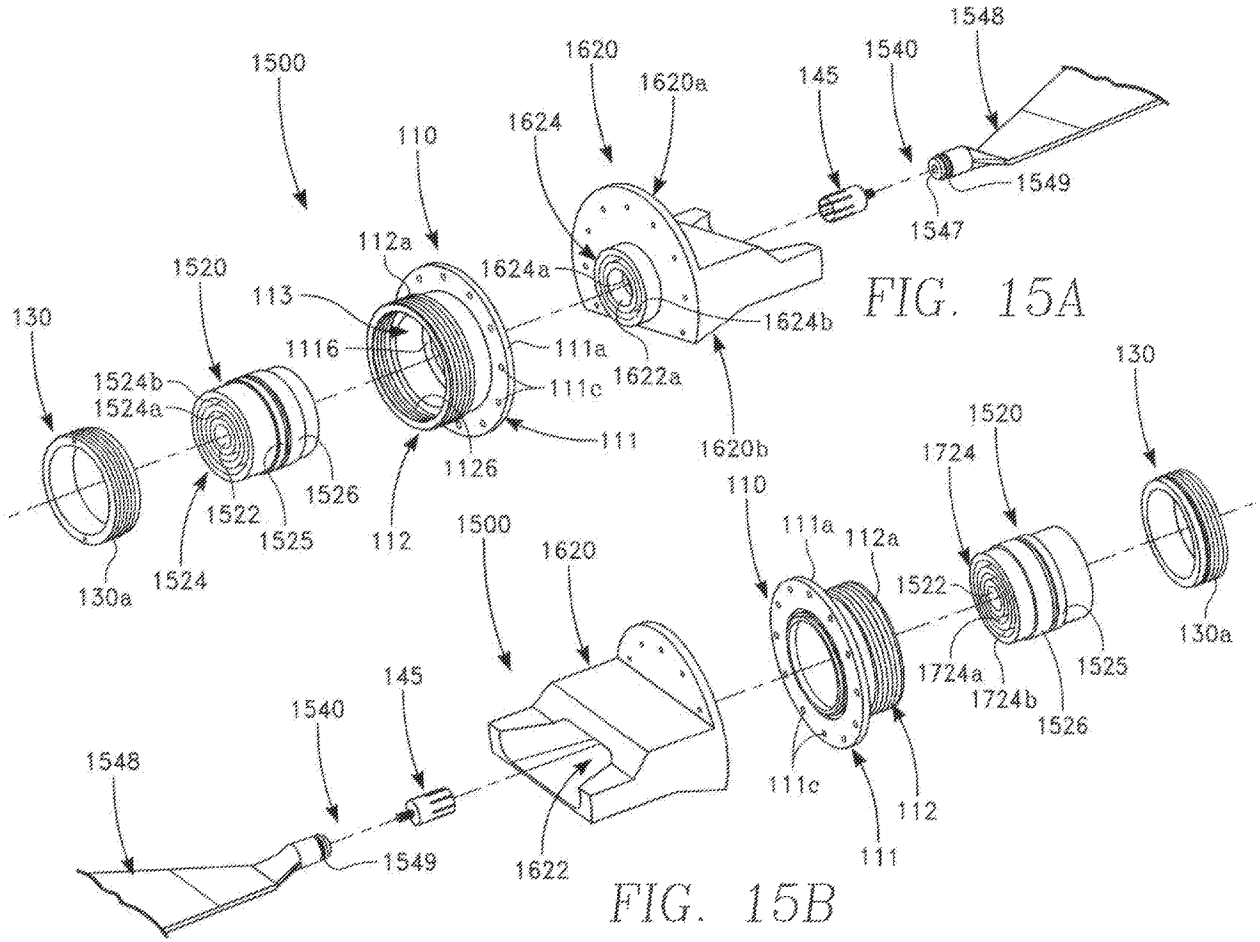
FIGS. 15A and 15B are illustrations of exploded views of another embodiment of the bulkhead connector and show the front perspective and rear perspective views of the bulkhead connector, respectively.

In particular, the center conductor 140 may be disposed within the axial bore 122 of the bulkhead connector dielectric insert 120 and may comprise: a head 145 and a cylindrical body 148. The cylindrical body 148 may also have a threaded bore 147, a center bore 146, and a neck portion 149. The threaded bore 147 may threadably couple with the head 145, thereby allowing the neck portion 149 to form an intermediate annular recess. The intermediate annular recess may be used to engaged with the annular protrusion 122*a* located within the axial bore 122 of the bulkhead connector dielectric insert 120. The center bore 146 may be used for electrically coupling of the bulkhead connector 100. In other embodiments, the center conductor may comprise a stripline transition piece in lieu of the cylindrical body 148, as shown in FIGS. 15A to 15C below.

Figure 5:
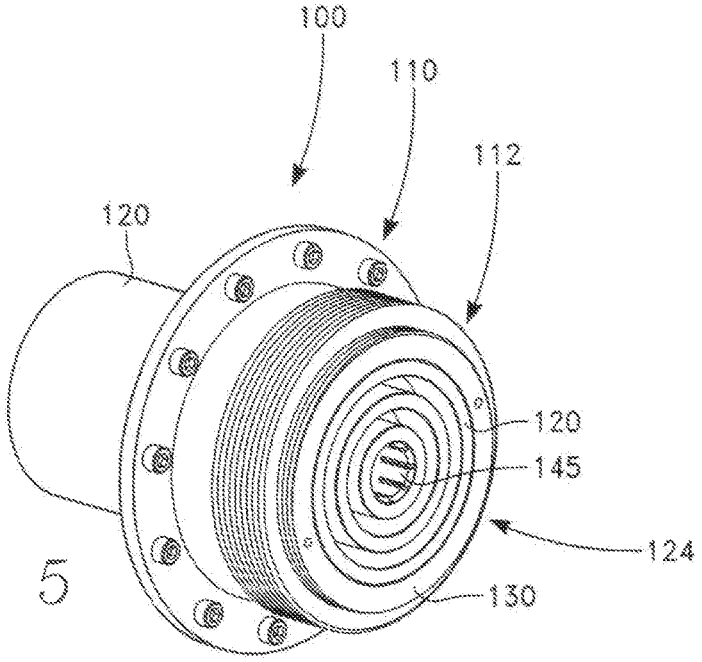
FIG. 5 is an illustration of an assembled view of one embodiment of a bulkhead connector.

FIG. 5 is an illustration of an assembled view of one embodiment of a bulkhead connector. FIG. 5 shows the mating face 124 of the bulkhead connector dielectric insert 120 and that the mating face 124 may be adjacent to the first dielectric locking ring 130 and threaded end 112 of the bulkhead connector body 110. The first dielectric locking ring 130 may also be threadably engaged with the threaded end 112 of the bulkhead connector body 110 in order to secure the bulkhead connector dielectric insert 120.

Figure 6:
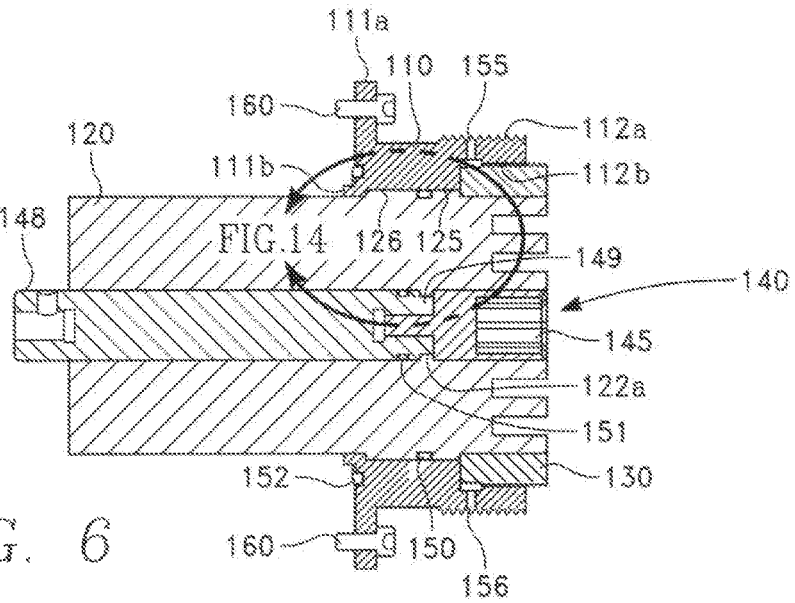
FIG. 6 is an illustration of an assembled, cross section view of one embodiment of a bulkhead connector.

FIG. 6 is an illustration of an assembled, cross section view of one embodiment of a bulkhead connector. FIG. 6 shows how the bulkhead connector 100 may be assembled. The bulkhead via flange screws 160 may be coupled to the fastener holes 111*e* of the outer flange 111*a* of the bulkhead connector body 110 for mounting the bulkhead connector body 110. The bulkhead connector dielectric insert 120 may be disposed within the cavity 113 of the bulkhead connector body 110, wherein the annular protrusion 111*b* of the bulkhead connector body 110 may be used to support and secure the bulkhead connector dielectric insert 120 by abutting against the annular shoulder 126 of the bulkhead connector dielectric insert 120. The center conductor 140 may be disposed and secured within the axial bore 122 of the bulkhead connector dielectric insert 120 via the annular protrusion 122*a*, such that the annular protrusion 122*a* bites the neck portion 149 of the center conductor 140.

Finally, O-rings 150, 151, 152 may be used to hermetically seal the bulkhead connector. O-ring 150 may be positioned within the cavity 113 of the bulkhead connector body 110. O-ring 151 may be situated within the axial bore 122 of the bulkhead connector dielectric insert 120. O-ring 152 may be inserted in an O-ring slot located at the flanged end 111 of the bulkhead connector body 110.

Figure 7:
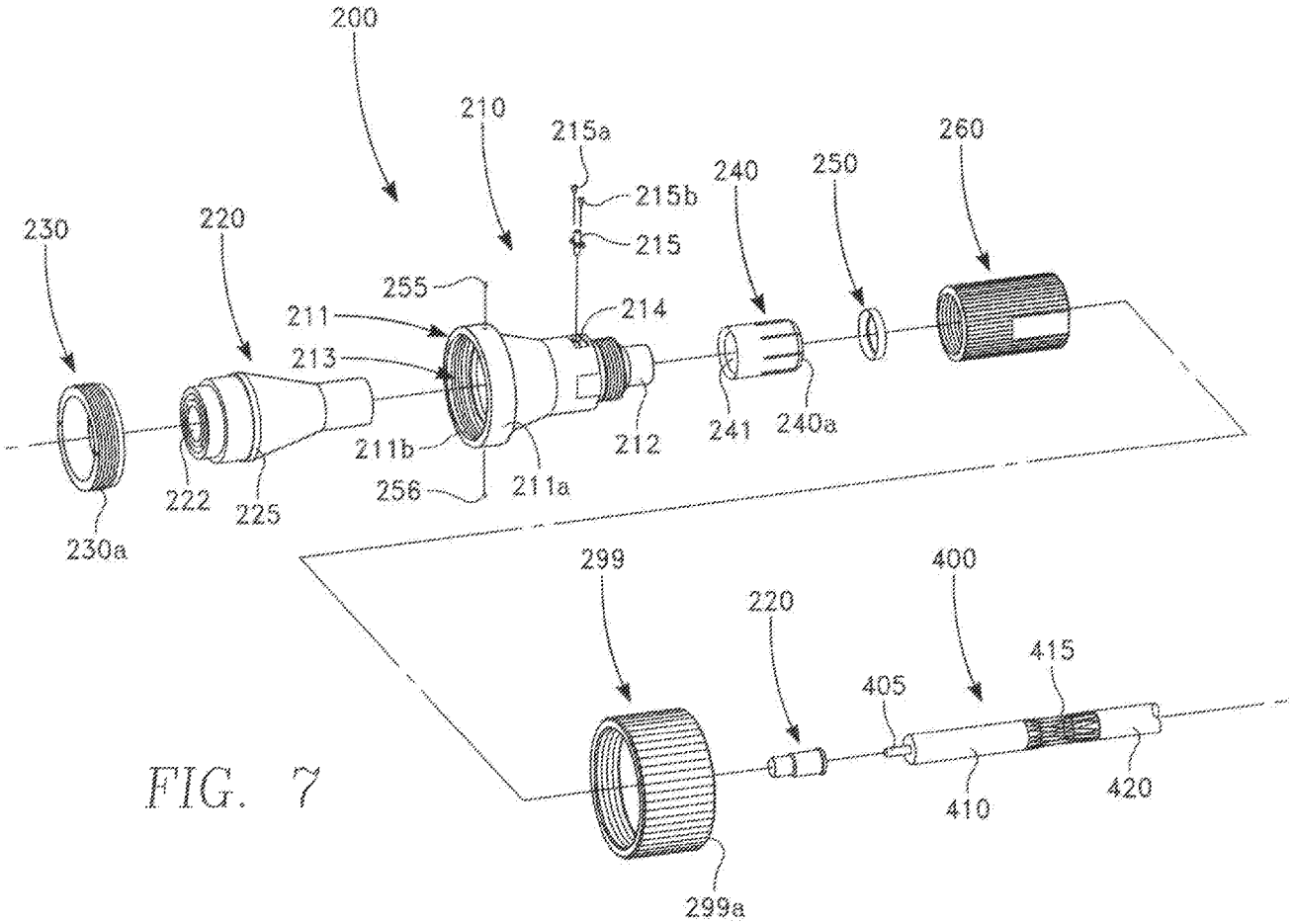
FIG. 7 is an illustration of an exploded, perspective view of one embodiment of a coaxial cable connector.

FIG. 7 is an illustration of an exploded, perspective view of one embodiment of a coaxial cable connector. As shown in FIG. 7, the coaxial cable connector 200 may comprise a coaxial cable connector body 210, which is generally tapered and may have a base end 211, a tapered end 212 and a cavity 213, which may also be generally tapered. The base end 211 of the coaxial cable connector body 210 may have a larger diameter than the tapered end 212 and may comprise a circular rim portion 211*a* and inner threads 211*b*.

The tapered end 212 of the coaxial connector body 210 may be used to secure the coaxial connector 200 to a coaxial cable 400 via a shield compress retainer 240, shield compress ring 250, and jacket cover 260. Specifically, the shield compress retainer 240 may engage with the tapered end 212 of said coaxial cable connector body 210 and may comprise: a shield compress retainer bore 241 and circumferentially arranged spring fingers 240*a*. The circumferentially arranged spring fingers 240*a* may be located at the tapered end of the shield compress retainer 240 and may be configured to grip or hold the coaxial cable 400. The jacket cover 260 may be used to cover, house, and protect the compress retainer 240 and shield compress ring 250 by having the inner mating threads 260*a* of the jacket cover 260 threadably engage with the outer threads 212*a* of the coaxial cable connector body 210. The shield compress retainer 240 and shield compress ring 250 may be disposed within a cavity of the jacket cover 260.

As discussed above, the coaxial cable connector dielectric insert 220 may be fitted within the generally tapered cavity 213 of the coaxial cable connector body 210 and may comprise an annular shoulder 225 that contacts and abuts the second dielectric locking ring 230 of the coaxial cable connector body 210. Importantly, the coaxial cable connector dielectric insert 220 may also comprise circular grooves 224*a*, 224*b*, 224*c* and an axial bore 222. The circular groove 124*a* may be concentrically disposed relative to the axial bore 222 on a mating face 224 of the coaxial cable connector dielectric insert 220. Additionally, the axial bore 222 may be centered on a longitudinal axis of the coaxial cable connector dielectric insert 220. Within the sidewall of the axial bore 222, an inner shoulder 222*a* may located to secure a center conductor plug 270 within the axial bore 222.

The center conductor plug 270 may be coupled to an end of the coaxial cable 400 and may be adapted to engage with the head 145 of the center conductor 140. The coaxial cable 400 may comprise a center conductor portion 405, a shield portion 415, a dielectric portion 410, and an insulation portion 420. The dielectric portion 410 may be disposed between the center conductor portion 405 and the shield portion 415. Additionally, the center connector plug 270 and the coaxial cable 400 may be disposed inside the axial bore 222 of the coaxial connector dielectric insert 220.

Figure 8:
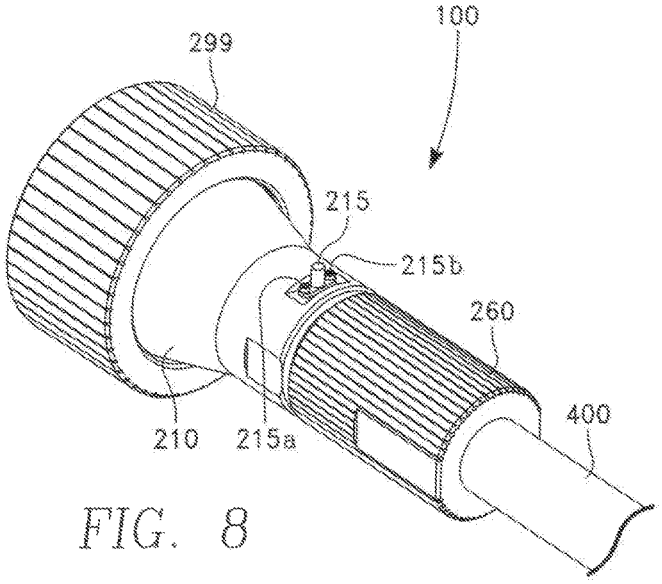
FIG. 8 is an illustration of an assembled view of one embodiment of a coaxial cable connector.

FIG. 8 is an illustration of an assembled view of one embodiment of a coaxial cable connector. As shown in FIG. 8, one embodiment of the coaxial cable connector 200 may comprise: a coaxial cable connector body 210, a capacitive differential probe 215 with screws 215*a*, 215*b*, a jacket cover 260, and a mating connector ring 299. FIG. 8 shows how the mating connector ring 299 and its annular protrusion 299*a* surrounds the circular rim portion 211*a* of the base end 211 of the coaxial cable connector body 210, such that the circular rim portion 211*a* is flushed against the annular protrusion 299*a* of the mating connector ring 299. FIG. 8 also shows the jacket cover 260 housing the shield compress retainer 240 and shield compress ring 250 at the tapered end of the coaxial cable connector body 210. Finally, FIG. 8 shows the capacitive differential probe 215 coupled to the voltage monitor test point 214 on the coaxial cable connector body 210 via screws 215*a*, 215*b*.

Figure 9:
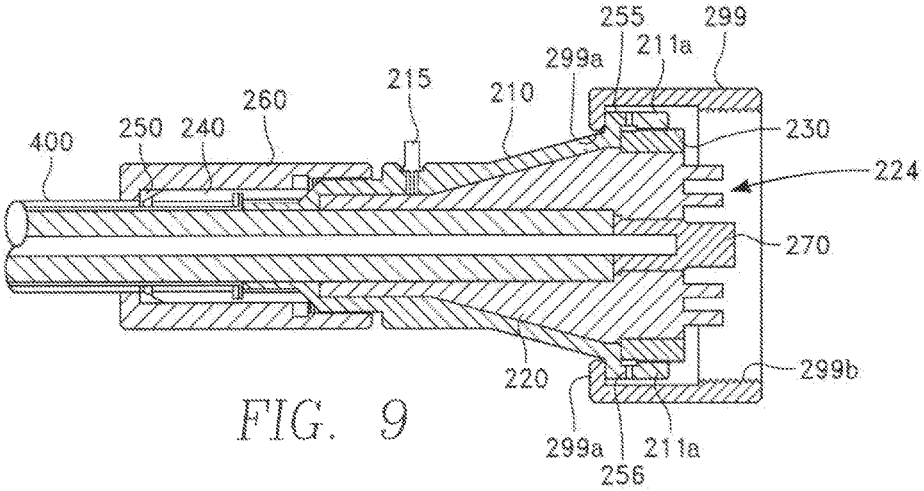
FIG. 9 is an illustration of an assembled, cross section view of one embodiment of a coaxial cable connector.

FIG. 9 is an illustration of an assembled, cross section view of one embodiment of a coaxial cable connector. FIG. 9 shows the mating connector ring 299 and its annular protrusion 299*a* may surround the circular rim portion 211*a* of the base end 211 of the coaxial cable connector body 210, thereby positioning the inner threads 299*b* of the mating connector ring 299 around the mating face 224 of the coaxial cable connector dielectric insert 220. Set screws 255, 256 may also be used to secure the second dielectric locking ring 230 within the base end 211 of the coaxial cable connector body 210 in order to secure the coaxial cable connector dielectric insert 220 within the cavity 213 of the coaxial cable connector body 210.

FIG. 9 also shows the jacket cover 260 housing the shield compress retainer 240 and shield compress ring 250 at the tapered end of the coaxial cable connector body 210. In this manner, the shield compress ring 250 may compress the circumferentially arranged spring fingers 240*a* and may constrict the bore of the shield compress retainer 240 in order to hold and secure the coaxial cable 400.

Figure 10:
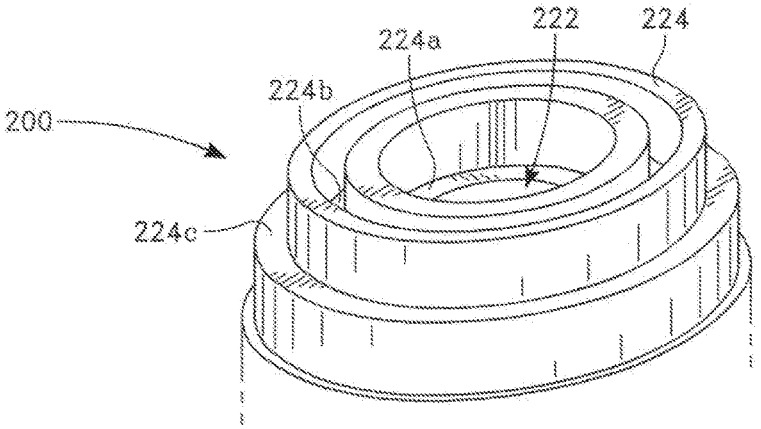
FIG. 10 is an illustration of a perspective view of one embodiment of a coaxial cable connector dielectric insert and shows the mating face of the coaxial cable connector dielectric insert.

FIG. 10 is an illustration of a perspective view of one embodiment of a coaxial cable connector dielectric insert and shows the mating face of the coaxial cable connector dielectric insert. As shown in FIG. 10, one embodiment of the coaxial cable connector dielectric insert 220 may comprise a mating face 224 having circular grooves 224*a*, 224*b*, 224*c* and an axial bore 222. The circular grooves 224*a*, 224*b*, 224*c* and axial bore 222 may be arranged concentrically with respect to each other. The overall shape of the mating face 224 of the coaxial cable connector dielectric insert 220 may also be used to create an air gap 500 when mating or engaging with the mating face 124 of the bulkhead connector dielectric insert 120.

Figure 11:
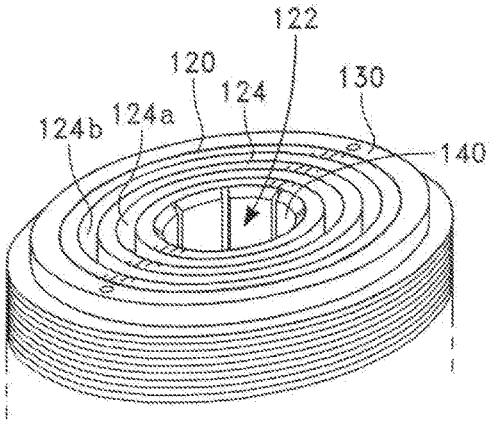
FIG. 11 is an illustration of a perspective view of one embodiment of the bulkhead connector and shows the mating face of the bulkhead connector.

FIG. 11 is an illustration of a perspective view of one embodiment of the bulkhead connector and shows the mating face of the bulkhead connector. As shown in FIG. 11, one embodiment of the bulkhead connector 100 may comprise a bulkhead connector dielectric insert 120, first dielectric locking ring 130, and a center conductor 140. Importantly, the bulkhead connector dielectric insert 120 may have a mating face 124 with circular grooves 124*a*, 124*b* and an axial bore 122.

FIG. 11 shows that the circular grooves 124*a*, 124*b* and axial bore 122 may be arranged concentrically with respect to each other. The circular grooves 124*a*. 124*b* and axial bore 122 may also be arranged, such that the mating face 124 of the bulkhead connector dielectric insert 120 may mate and engage with the mating face 224 of the coaxial cable connector dielectric insert 220. Importantly, the overall shape of the mating face 124 of the bulkhead connector dielectric insert 120 may also be used to create an air gap when mating or engaging with the mating face 224 of the coaxial cable connector dielectric insert 220. Further details of the air gap 500 are described below.

Figure 12A:
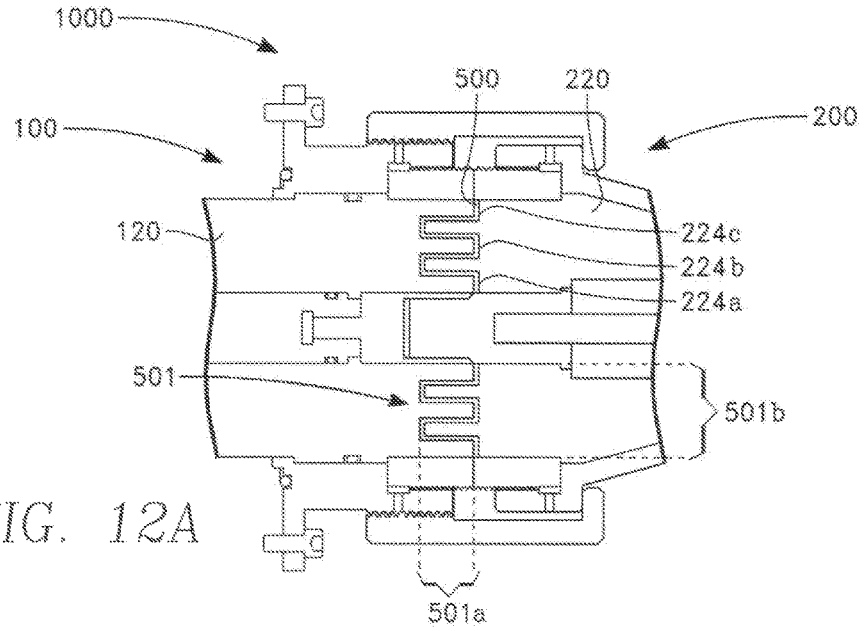
FIGS. 12A and 12B depict portions of one embodiment of the high voltage RF coaxial cable connector and show first air gap and second air gap, respectively.
Figure 12B:
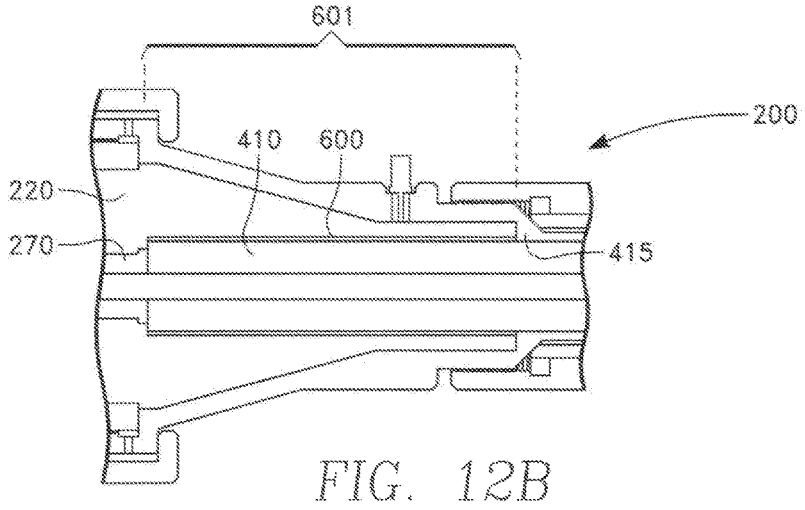

FIGS. 12A and 12B depict portions of one embodiment of the high voltage RF coaxial cable connector and show first air gap and second air gap. Specifically, FIG. 12A shows how the first air gap 500 is formed when the bulkhead connector 100 and the coaxial cable connector 200 are mated together. FIG. 12B shows the second air gap 600 within the coaxial cable connector 200.

In some embodiments, the high voltage RF coaxial cable connector 1000 may be capable of withstanding electric field strengths of about 200 kV (or 215.25 kV based on a nominal 75 volts/mils breakdown of air). Thus, a first air gap 500 is needed at the mating connection point between the bulkhead connector dielectric insert 120 and coaxial cable connector dielectric insert 220. Given that air breakdown generally occurs at 75 volts/mil, the first air gap 500 may have a minimum first air gap distance 501 of 2.87 inches to satisfy the 200 kV voltage standoff requirement (nominally 215.25 kV).

To help fulfill the minimum air gap distance of 2.87 inches, circular grooves 224*a*, 224*b*, 224*c* may be added onto the mating face 224 of the coaxial cable connector dielectric insert 220. The circular grooves 224*a*, 224*b*, 224*c* may help create a longer air path distance from the inner radius of the coaxial cable connector dielectric insert 220 (e.g., center conductor portion 405 of the coaxial cable 400) to the outer radius of the coaxial cable connector dielectric insert 220 (e.g., coaxial cable connector body 210) by creating horizontal travel distances 501*a* and vertical travel distances 501*b* on the mating faces 124, 224 of the bulkhead connector dielectric insert 120 and the coaxial cable connector dielectric insert 220. For example, one embodiment of the mating face 224 may comprise three circular grooves 224*a*, 224*b*, 224*c*, and each circular groove 224*a*, 224*b*, 224*c* may be approximately 0.174 inches thick and approximately 0.5 inches deep. Thus, given that the three circular grooves 224*a*, 2246, 224*c* create four transition grooves in-between circular grooves 224*a* and 224*b* and in-between circular grooves 224*b*, 224*c*, a total horizontal travel distance of approximately 2 inches and a total vertical travel distance of approximately 0.87 inches may be created. As such, assuming that the dielectric breakdown in air is 75 volts/mil, the first air gap distance 501 may be approximately 2.87 inches, which may endure a voltage standoff of approximately 215.25 kV in open air.

With the vertical travel distance 501*b* being 0.87 inches for one embodiment of the high voltage RF coaxial cable connector 1000, the inner and outer diameters of the bulkhead connector dielectric insert 120 and coaxial cable connector dielectric insert 220 may also be calculated. For example, for frequencies between 1 to 1000 MHz, the high voltage RF coaxial cable connector 1000 may have an RF impedance of 50 ohms. Thus, in order to meet the 50 ohms of RF impedance requirement, the inner and outer diameters of the bulkhead connector dielectric insert 120 and coaxial cable connector dielectric insert 220 may be calculated using the following dielectric equation:

$$Z_0 = \frac{1}{2\pi}\sqrt{\frac{\mu_0\mu_r}{\varepsilon_0\varepsilon_r}}\ln\left(\frac{d_o}{d_i}\right)$$

where:

$z_0$ is the impedance $\varepsilon_0$=8.85 [pF/m]

$\varepsilon_r$ is the dielectric constant $\mu_0$=40*pi [uH/m]

$\mu_r$ is the permeability $d_0$ is the diameter of the outer dielectric $d_i$ is the diameter of the inner dielectric Given that the difference of the inner and outer diameters of the bulkhead connector dielectric insert 120 and coaxial cable connector dielectric insert 220 is equivalent to the vertical travel distance 501*b* of 0.87 inches, the outer diameter $d_0$ of the bulkhead connector dielectric insert 120 and coaxial cable connector dielectric insert 220 may be expressed in following equation:

$$d_0=d_i+2(0.87\text{ in})$$

Finally, in order to determine the inner diameter $d_i$, the above equation may be combined with the following dielectric equation:

$$Z_0 = \frac{1}{2\pi}\sqrt{\frac{\mu_0\mu_r}{\varepsilon_0\varepsilon_r}}\ln\left(\frac{d_o}{d_i}\right)$$

to yield the following:

$$d_i = d_0 * e^{-\left(2\pi Z_0\sqrt{\frac{\varepsilon_0\varepsilon_r}{\mu_r\mu_0}}\right)}$$

Regarding the synthetic resin Teflon®, Teflon® generally has a dielectric constant of 2.1 and a permeability of 1.0. Thus, in order for the high voltage RF coaxial cable connector 1000 to achieve a 200 kV voltage standoff (nominally 215.25 kV), one embodiment of the inner diameter $d_i$ may be approximately 0.65 inches.

Finally, when inputting the inner diameter $d_i$ as 0.65 inches for following equation:

$$d_0 = d_i + 2(0.87 \text{ in})$$

the outer diameter $d_0$ may be approximately 2.39 inches.

Accordingly, embodiments of the bulkhead connector dielectric insert 120 and coaxial cable connector dielectric insert 220 may have an inner diameter $d_i$ of 0.65 inches and an outer diameter $d_0$ of 2.39 inches. Notably, the size of the inner diameters $d_i$ of the bulkhead connector dielectric insert 120 and the coaxial cable connector dielectric insert 220 may be same as the outer diameter of the center conductor portion 405 of the coaxial cable 400.

More importantly, FIG. 12B shows that the coaxial cable connecter 200 may have a second air gap 600 concentrically formed in-between the dielectric portion 410 of the coaxial cable 400 and coaxial cable connector dielectric insert 220. The second air gap 600 may also extend from the center conductor plug 270 to the shield portion 415 of the coaxial cable 400, thereby creating a second air gap distance 601. Preferably, in one or more embodiments, the second air gap distance 601 is approximately the same as the first gap distance 501 of the first air gap 500. For example, in order to withstand a voltage standoff requirement of 200 kV (nominally 215.25 kV), one embodiment of the second air gap 600 may have an air gap distance 601 of approximately 2.87 inches.

Figure 13:
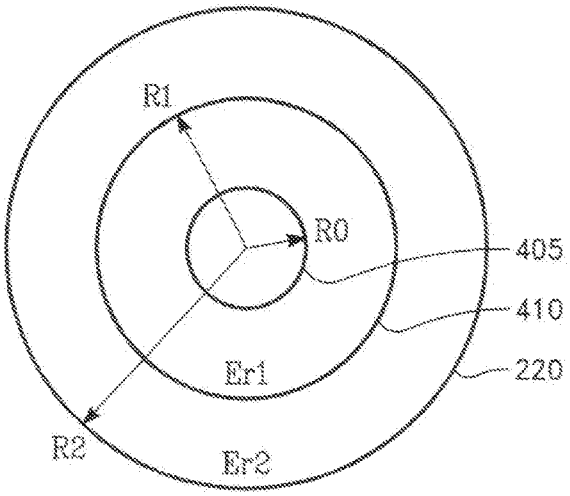
FIG. 13 is an illustration of a dual dielectric diagram to help show the relation between voltage breakdown, impedance, and connector size.

FIG. 13 is an illustration of a dual dielectric diagram. As shown in FIG. 13, one embodiment of the dual dielectric diagram may include: a center conductor portion 405 of the coaxial cable 400 having a radius $R_0$, a dielectric portion 410 of the coaxial cable 400 having a radius $R_1$, and the coaxial cable connector dielectric insert 220 having a radius $R_2$. The dual dielectric diagram preferably helps illustrates static capacitance between the inner conductor (i.e., dielectric portion 410) and the outer conductor (i.e., coaxial cable connector dielectric insert 220). Assuming that an imaginary cylinder exists between the inner and outer conductors, two capacitance values may be calculated: (1) the capacitance (per meter length of cable) between the dielectric portion 410 and the cylinder; and (2) the capacitance between the cylinder and the coaxial cable connector dielectric insert 220. The capacitance per meter of cable between the inner conductor and outer conductor may be calculated by combining the two capacitance values in a series combination.

Generally, an abrupt transition occurs between the center conductor 140 of the high voltage RF coaxial cable connector 1000 and the center conductor portion 405 of the coaxial cable 400. In order to perform impedance matching on these points while maintaining a high voltage breakdown, the abrupt transition may be followed by a dual dielectric configuration involving the coaxial cable connector dielectric insert 220 and the dielectric portion 410 of the coaxial cable 400. This configuration may create a long air gap transition between the dielectric portion 410 and the coaxial cable connector dielectric insert 220. One embodiment of the coaxial cable connector dielectric insert 220 may be constructed of synthetic resin material such as Teflon® while the dielectric portion 410 of the coaxial cable 400 may be constructed of high-density polyethylene (HDPE).

As a general rule, coaxial cable impedance is the square-root of the ratio of inductance per length divided by the capacitance per length:

$$Z_0 = \sqrt{\frac{L'}{C'}} = \sqrt{1000\frac{L}{C}}$$

In order to determine the capacitance C for multiple dielectrics, the capacitance may be determined by performing a series combination for the capacitances (i.e., adding their individual capacitances in series). Thus, in order to calculate the capacitance of the coaxial cable connector dielectric insert 220 and the dielectric portion 410 of the coaxial cable 400, the sum or series combination of the above two capacitance values should be determined, which would be: (1) the capacitance (per meter length of cable) for the inner conductor, which may be the dielectric portion 410 of the coaxial cable 400; and (2) the capacitance for the outer conductor, which may be the coaxial cable connector dielectric insert 220.

In order to calculate the capacitance per length of a single-dielectric, the following equation is generally used:

$$C_{(F/m)} = \frac{2\pi * E_r * \varepsilon_0}{\ln\left(\frac{R_1}{R_0}\right)}$$

Thus, by replacing $E_r$ with $E_{r1}$ for the inner conductor or dielectric portion 410 of the coaxial cable 400, the capacitance per meter length for the dielectric portion 410 may be determined by the following equation:

$$C_{(F/m)} = \frac{2\pi * E_{r1} * \varepsilon_0}{\ln\left(\frac{R_1}{R_0}\right)}$$

On the other hand, by replacing $E_r$ with $E_{r2}$ for the outer conductor or coaxial cable connector dielectric insert 220, the capacitance per meter length for the coaxial cable connector dielectric insert 220 is generally:

$$C_{(F/m)} = \frac{2\pi * E_{r2} * \varepsilon_0}{\ln\left(\frac{R_2}{R_1}\right)}$$

Accordingly, when combining the two capacitances above in a series combination, the total capacitance C per meter length can be determined by the following equation:

$$C_{td} = \frac{C_{1d} * C_{2d}}{C_{1d} + C_{2d}} = \frac{2\pi * \varepsilon_0 * E_{r1} * E_{r2}}{E_{r1} * \ln\left(\frac{R_2}{R_1}\right) + E_{r2} * \ln\left(\frac{R_1}{R_0}\right)}$$

where capacitance C could be found using the following equation:

$$C = \frac{2\pi * 8.8541878 * E_{r1} * E_{r2}}{3.2808 * \left[E_{r1} * \ln\left(\frac{R_2}{R_1}\right) + E_{r2} * \ln\left(\frac{R_1}{R_0}\right)\right]}$$

Using the above equation, inductance L may be found using the following:

$$L = \frac{200 * \ln\left(\frac{R_2}{R_0}\right)}{3.2808}$$

Finally, the effective dielectric constant $K_{eff}$ is the ratio of the capacitance of the structure to the capacitance if the dielectrics were placed within a vacuum (or air):

$$K_{eff} = \frac{C_{td}}{C_{ta}}$$

where:

$$C_{ta} = \frac{2\pi * \varepsilon_0}{\ln\left(\frac{R_2}{R_0}\right)}$$

This gives the following expression for the effective dielectric constant:

$$K_{eff} = \frac{E_{r1} * E_{r2} * \ln\left(\frac{R_2}{R_0}\right)}{E_{r1} * \ln\left(\frac{R_2}{R_1}\right) + E_{r2} * \ln\left(\frac{R_1}{R_0}\right)}$$

By using the above equations, the overall impedance may be calculated and can be used to determine the impedance at the widest point on the coaxial cable connector 200.

In various embodiments, the coaxial cable connector dielectric insert 220 may be tapered at about 15 degrees from the center longitudinal axis of the coaxial cable connector 200. The 15 degree angle may also allow a breakdown path in the synthetic resin Teflon® between the large mating end of connector dielectric insert 220 to its tapered end enclosing the coaxial cable 400. This may help prevent voltage breakdown for the coaxial cable 400.

Figure 14:
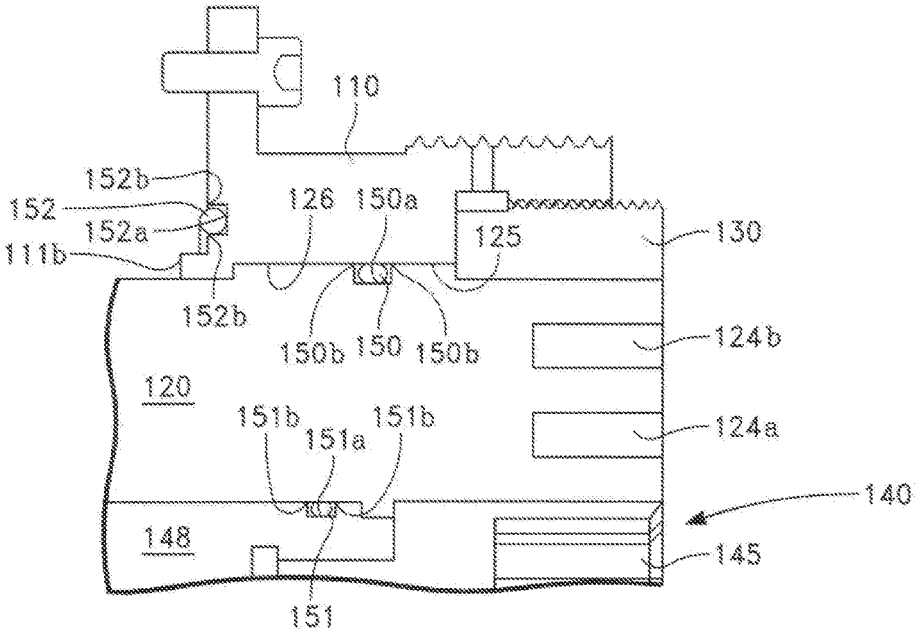
FIG. 14 is an illustration of a close up view of one embodiment of a bulkhead connector and shows the O-ring slots of the bulkhead connector.

FIG. 14 is an illustration of a close up view of one embodiment of a bulkhead connector and shows the O-ring slots of the bulkhead connector. As shown in FIG. 14, one embodiment of the bulkhead connector 100 may comprise: a bulkhead connector body 110, bulkhead connector dielectric insert 120, a first dielectric locking ring 130, a center conductor 140 having a head 145 and a cylindrical body 148, and O-rings 150, 151, 152.

As discussed above, the bulkhead connector 100 may hermetically seal the open air within the bulkhead connector 100. Thus, various embodiments of the bulkhead connector 100 may be subject in oil and/or gas filled environments. In order to provide a tight seal, the bulkhead connector body 110, bulkhead connector dielectric insert 120, and the cylindrical body 148 may have one or more O-ring slots 150*a*, 151*a*, 152*a*, each adapted to retain O-rings 150, 151, 152. In various embodiments, O-ring 150 may be inserted within the cavity 113 of the bulkhead connector body 110; O-ring 151 may be inserted within the axial bore 122 of the bulkhead connector dielectric insert 120; and O-ring 152 may be inserted in an O-ring slot of the flanged end 111 of the bulkhead connector body 110.

Importantly, each O-ring slot 150*a*, 151*a*, 152*a* may have multiple annular edges 150*b*, 151*b*, 152*b*, and each annular edge 150*b*, 151*b*, 152*b* may be rounded to form a fillet. The rounded edges may be used to minimize or prevent voltage enhancement, which is usually caused by sharp internal/external edges or changes in the dielectric diameter.

FIGS. 15A and 15B are illustrations of exploded views of another embodiment of the bulkhead connector and show the front perspective and rear perspective views of the bulkhead connector, respectively. Unlike the embodiment of the bulkhead connector 100 shown in FIG. 4, the bulkhead connector 1500, shown in FIGS. 15A and 15B, preferably comprises two dielectric inserts—i.e., a first bulkhead connector dielectric insert 1520 and a second bulkhead connector dielectric insert 1620, both of which may be used to form another air gap 1800 (shown in FIG. 20) when engaged with one another. Additional details about air gap 1800 is discussed below.

As shown in FIGS. 15A and 15B, another embodiment of the bulkhead connector 1500 may comprise: a bulkhead connector body 110, which may be generally cylindrical and may have a flanged end 111, a threaded end 112 and a cavity 113, which may be generally cylindrical. The flanged end 111 of the bulkhead connector 1500 may likewise comprise an outer flange 111*a*, which may be an external rim or lip for mounting or attachment of the bulkhead connector 1500 to another object such as a bulkhead. The flanged end 111 may also comprise an annular protrusion 111*b*. The outer flange 111*a* may comprise fastener holes 111*c* for coupling the outer flange 111*a* to the bulkhead via flange screws 160. The annular protrusion 111*b* may be used to restrict longitudinal movement of the first bulkhead connector dielectric insert 1520 when the bulkhead connector dielectric insert 1520 moves or traverses through the cavity 113 of the bulkhead connector body 110.

On the other hand, like the embodiment shown in FIG. 4 above, the threaded end 112 of the bulkhead connector body 110 may threadably engage and secure the bulkhead connector 1500 to the coaxial cable connector 200. In particular, the threaded end 112 of the bulkhead connector body 110 may comprise outer threads 112*a* and inner threads 112*b*, wherein the outer threads 112*a* may threadably engage with the inner mating threads 299*a* of the mating connector ring 299. In this manner, the outer threads 112*a* may help secure the base end 211 of the coaxial connector body 210 and prevent relative movement of the bulkhead connector 1500 and the coaxial cable connector 200.

This may also help maintain the shape and size of the air gap 1500 (shown in FIG. 20) formed between the first bulkhead connector dielectric insert 1520 and the coaxial cable connector dielectric insert 220.

Additionally, like the embodiment shown in FIG. 4, the inner threads 112*b* of the bulkhead connector body 110 may help secure the first bulkhead connector dielectric insert 1520 to the bulkhead connector body 110. This may be achieved by threadably engaging the first dielectric locking ring 130 within the bulkhead connector body 110. Specifically, the first dielectric locking ring 130 may comprise outer mating threads 130*a* adapted to threadably engaged with the inner threads 112*b* of the bulkhead connector body 110. The first dielectric locking ring 130 may also have a diameter fitted to allow the first dielectric locking ring 130 to abut against the annular shoulder 1525 of the first bulkhead connector dielectric insert 1520. Thus, when the first bulkhead connector dielectric insert 1520 is positioned within the generally cylindrical cavity 113 of the bulkhead connector body 110, the annular shoulder 1526 of the first bulkhead connector dielectric insert 1520 may abut against the annular protrusion 1116 of the bulkhead connector body 110. In this manner, the first dielectric locking ring 130 may therefore secure the first bulkhead connector dielectric insert 1520 by threadably engaging the outer mating threads 130*a* of the first dielectric locking ring 130 with the inner threads 112*b* of the bulkhead connector body 110 in order for the first dielectric locking ring 130 to abut against the annular shoulder 1525 of the first bulkhead connector dielectric insert 1520.

The first bulkhead connector dielectric insert 1520 may also comprise a first end having a first mating face 1524 and a second end having a second mating face 1724. The first mating face 1524 may comprise two circular grooves 1524*a*, 1524*b* and an axial bore 1522. The two circular grooves 1524*a*, 1524*b* may be concentrically disposed with one another on a first mating face 1524 of the first bulkhead connector dielectric insert 1520, and the axial bore 1522 may be centered on a longitudinal axis of the first bulkhead connector dielectric insert 1520. Similarly, the second mating face 1724 may comprise two circular grooves 1724*a*, 1724*b* and the axial bore 1522, wherein the axial bore 1522 may extend through both the first mating face 1524 and second mating face 1724. The axial bore 1522 and the circular grooves 1524*a*, 1524*b*, 1724*a*, 1724*b* may concentrically arranged with each other. Within the sidewall of the axial bore 1522, an annular lip 1522*a* (shown in FIG. 17) may bite into center conductor 1540 to thereby retain and secure the center conductor 1540 within the axial bore 1522. Thus, the center conductor 1540 may be disposed within the axial bore 1522 of the first bulkhead connector dielectric insert 1520 and center cavity 1622 of the second bulkhead connector dielectric insert 1620 (shown in FIG. 17).

Importantly, unlike the embodiment shown in FIG. 4 above, the center conductor 1540 may comprise: a head 145 and a stripline transition piece 1548, which may be a transverse electromagnetic (TEM) transmission line medium. Additionally, the stripline transition piece 1548 may comprise: a threaded bore 1547 and a neck portion 1549. The threaded bore 1547 may threadably couple with the head 145, thereby allowing the neck portion 1549 to form an intermediate annular recess. The intermediate annular recess may engage with the annular protrusion 1522*a* located within the axial bore 1522 of the first bulkhead connector dielectric insert 1520. In an exemplary embodiment, the stripline transition piece 1548 may be a transverse electromagnetic (TEM) transmission line suitable for feeding signals into antennas, including ultra-wideband antennas. The dimensions of the transmission line, including the width, thickness, height from dielectric, dielectric constant, taper angle, and gradients are generally variables dependent on the descriptive components of the antenna: frequency, bandwidth, rise-time, fall-time, dielectric breakdown voltage, and environmental breakdown voltage. In some embodiments, the transmission line, in the application of an antenna, represents the impedance transition from the characteristic impedance of the coaxial cable and connector (approximately 50Ω) to the characteristic impedance of atmospheric air (approximately 377Ω).

Importantly, unlike the embodiment shown in FIG. 4, the bulkhead connector 1500 in FIGS. 15A and 15B preferably comprises a second bulkhead connector dielectric insert 1620, which may house a portion of the stripline transition piece 1548. To help with impedance matching compensation, to allow for higher electric field strengths, and to allow assembly and disassembly of the antenna, the second bulkhead connector dielectric insert 1620 in conjunction with the first bulkhead connector dielectric insert 1520 may form another air gap 650 when engaged with the second mating face 1724 of the first bulkhead connector dielectric insert 1620. The second bulkhead connector dielectric insert 1620 may comprise a mating face 1624 having circular grooves 1624*a*, 1624*b*, and a center bore 1622*a* leading to a cavity 1622 that houses a portions of the stripline transition piece 1548. The circular grooves 1624*a*, 1624*b* and center bore 1622*a* may be arranged concentrically with respect to each other, and, in some embodiment, be similar in size and shape to the mating face of 224 of the coaxial cable connector shown in FIG. 10. The center bore 1622*a* may also be centered on a longitudinal axis of the second bulkhead connector dielectric insert 1620.

Finally, FIGS. 15A to 15B also show that the second bulkhead connector dielectric insert 1620 may comprise an upper flanged portion 1620*a* and a bottom tapered portion 1620*b*. The upper flanged portion 1620*a* may be used to couple or attach the second bulkhead connector dielectric insert 1620 to an opposing surface of a bulkhead via fastener holes 1611 (shown in FIG. 17). The bottom tapered portion 1620*b*, on the other hand, may create an air gap between the bulkhead and bulkhead connector 1500. This air gap may be dimensioned to have an air gap distance equal or larger than the air gap distance between the bulkhead connector 1500 and coaxial cable connector 200.

Figure 16A:
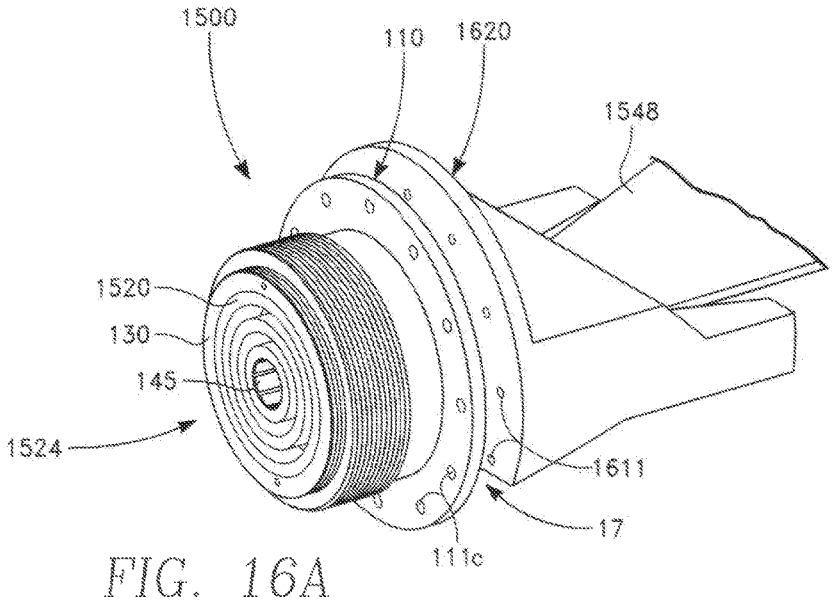
FIGS. 16A to 16C are illustrations of assembled views of another embodiment of the bulkhead connector and show the front perspective, rear perspective, and side elevation views of the bulkhead connector, respectively.
Figure 16B:
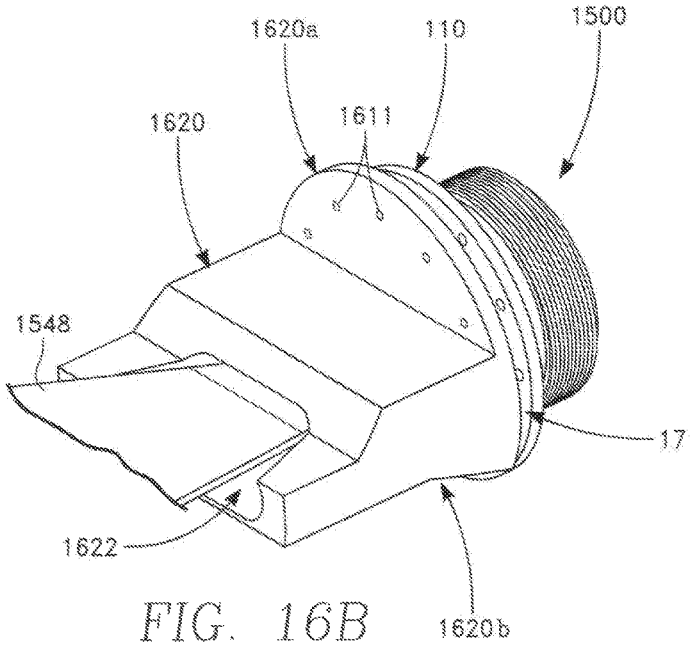
Figure 16C:
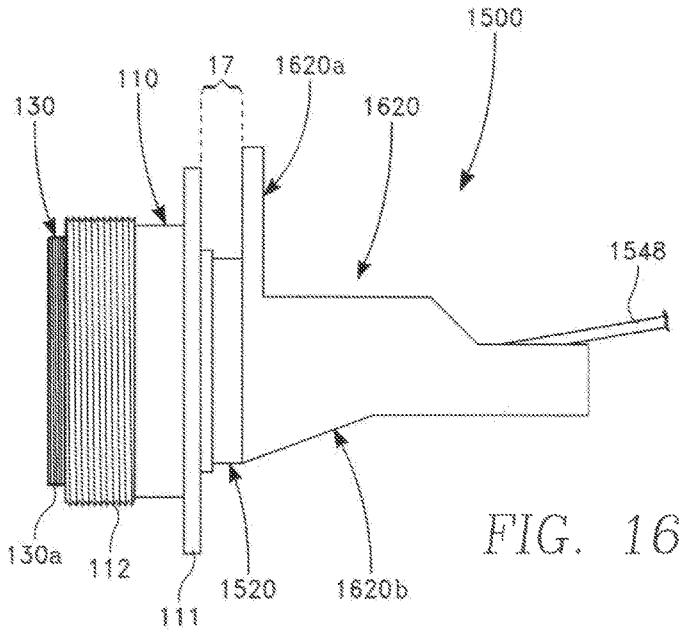

FIGS. 16A to 16C are illustrations of assembled views of another embodiment of the bulkhead connector and show the front perspective, rear perspective, and side elevation views of the bulkhead connector, respectively. FIG. 16A also shows the mating face 1524 of the first bulkhead connector dielectric insert 1520 and how that mating face 1524 may be adjacent to the first dielectric locking ring 130 and threaded end 112 of the bulkhead connector body 110. The first dielectric locking ring 130 may be threadably engaged with the threaded end 112 of the bulkhead connector body 110 in order to secure the first bulkhead connector dielectric insert 120.

FIGS. 16B and 16C, which depicts the rear perspective and side elevation views of the bulkhead connector 1500, show in detail the upper flanged portion 1620*a* and a bottom tapered portion 1620*b* of the second bulkhead connector dielectric insert 1620. The upper flanged portion 1620*a* may be used to couple or attach the second bulkhead connector dielectric insert 1620 to an opposing surface of a bulkhead via fastener holes 1611. The bottom tapered portion 1620*b* may provide an air gap, which may have an air gap distance equal to or larger than the air gap distance between the bulkhead connector 1500 and coaxial cable connector 200. Furthermore, FIG. 16B shows how the stripline transition piece 1548 traverses through the center cavity 1622 of the second bulkhead connector dielectric insert 1620.

Finally, FIGS. 16A to 16C show that the bulkhead connector 1500 may have a gap 17 between the bulkhead connector body 110 and dielectric insert 1620. The gap 17 may be configured for mounting the bulkhead connector 1500 onto a bulkhead 1800 (shown in FIG. 17). Importantly, the size of the gap 17 may be affected by the thickness of the bulkhead 1800. For example, in one embodiment, if the bulkhead 1800 to be mounted between the bulkhead connector body 110 and dielectric insert 1620 is ¼ inches thick, then that the gap 17 of the bulkhead connector 1500 is preferably at least approximately ¼ inches thick.

Figure 17:
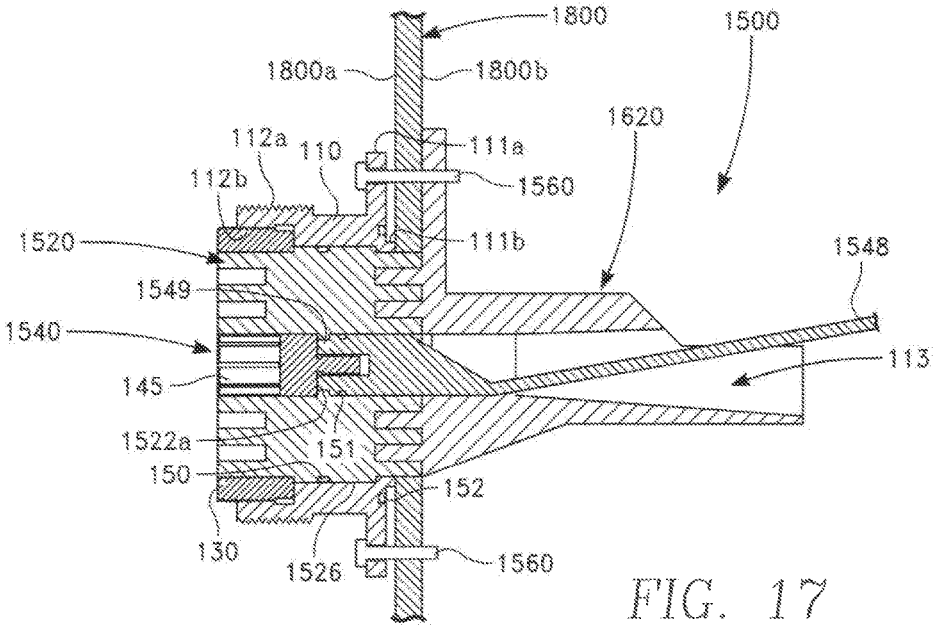
FIG. 17 is an illustration of a cross section view of another embodiment of the bulkhead connector and shows the bulkhead connector coupled to a bulkhead.

FIG. 17 is an illustration of a cross section view of another embodiment of the bulkhead connector and shows the bulkhead connector coupled to a bulkhead. FIG. 17 also shows how the bulkhead connector 1500 may be assembled. When mounting the bulkhead connector 1500, flange screws 1560 may be engaged through the fastener holes 111*c* of the outer flange 111*a* of the bulkhead connector body 110 and to a front surface 1800*a* of the bulkhead 1800. Conversely, the second bulkhead connector dielectric insert 1620 may couple to the opposing surface 1800*b* of the bulkhead 1800 via the flange screws 1560. Thus, in multiple embodiments, the flange screws 1560 may engage both the fastener holes 111*c* of the outer flange 111*a* of the bulkhead connector body 110 and fastener holes 1611*c* of the second bulkhead connector dielectric insert 1620.

Importantly, FIG. 17 shows that the first bulkhead connector dielectric insert 120 may be disposed within the cavity 113 of the bulkhead connector body 110. The annular protrusion 1116 of the bulkhead connector body 110 may be used to support and secure the first bulkhead connector dielectric insert 1520 by abutting against the annular shoulder 1526 of the first bulkhead connector dielectric insert 1520. The center conductor 1540, which includes the stripline transition piece 1548, may be disposed and secured within the axial bore 1522 of the first bulkhead connector dielectric insert 1520 via the annular protrusion 1522*a*, such that the annular protrusion 1522*a* bites the neck portion 1549 of the center conductor 1540. The stripline transition piece 1548 of the center conductor 1540 may also be disposed within the center cavity 1622 of the second bulkhead connector dielectric insert 1620.

Finally, O-rings 150, 151, 152 may be used to hermetically seal the bulkhead connector 1500. O-ring 150 may be positioned within the cavity 113 of the bulkhead connector body 110. O-ring 151 may be situated within the axial bore 1522 of the first bulkhead connector dielectric insert 1520. O-ring 152 may be inserted in an O-ring slot located at the flanged end 111 of the bulkhead connector body 110.

Figure 18:
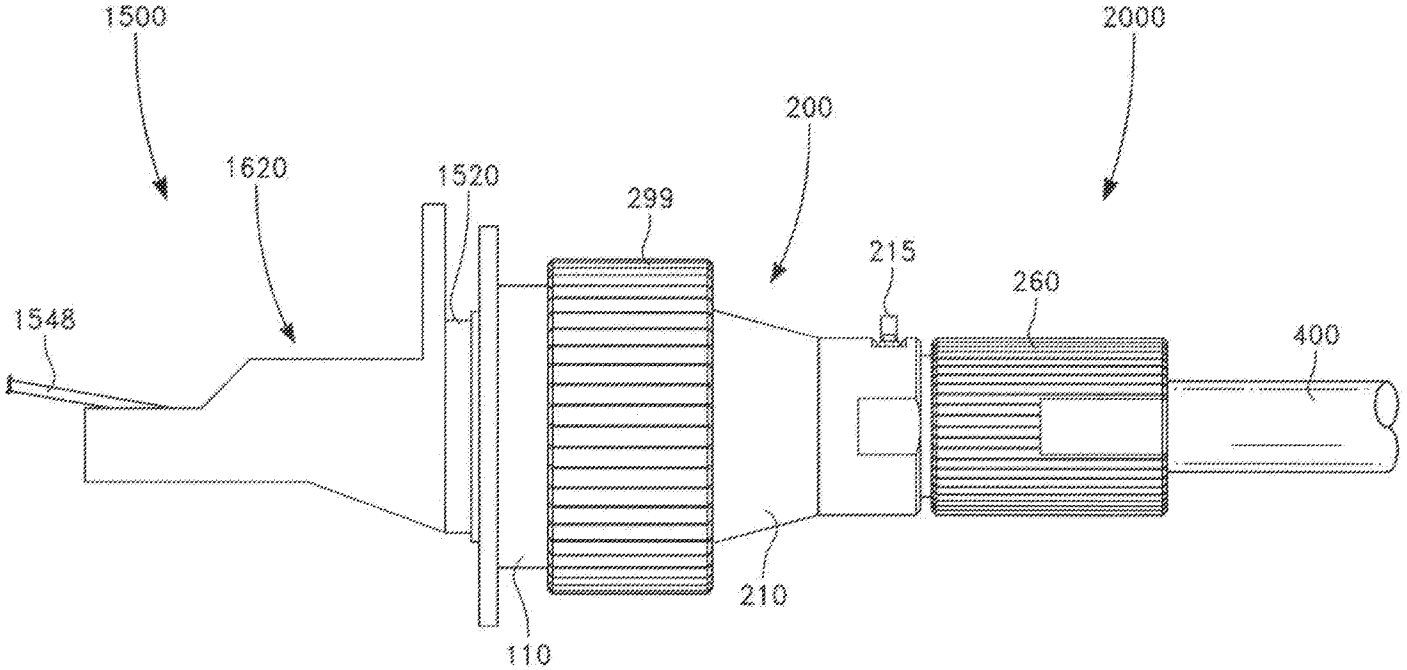
FIG. 18 is an illustration of a side elevation view of another embodiment of the high voltage RF connector and shows the coaxial cable connector matingly engaged with the bulkhead connector having a stripline transition.

FIG. 18 is an illustration of a side elevation view of another embodiment of the high voltage RF connector and shows the coaxial cable connector matingly engaged with the bulkhead connector having a stripline transition. As shown in FIG. 18, another embodiment of the high voltage RF connector 2000 may comprise a bulkhead connector 1500 mated with a coaxial cable connector 200. Importantly, FIG. 18 shows how the mating connector ring 299 couples to the base end 211 of the coaxial cable connector body 210 with the bulkhead connector body 110. In particular, like the embodiment shown in FIG. 2B, the circular rim portion 211*a* may be flushed against the annular protrusion 299*a* of the mating connector ring 299, such that one end of the mating connector ring 299 is engaged the circular rim portion 211*a* of the base end 211 of the coaxial cable connector body 210. The other end of the mating connector ring 299 may be threadably engaged with the outer threads 112*a* of the bulkhead connector body 110.

Figure 19:
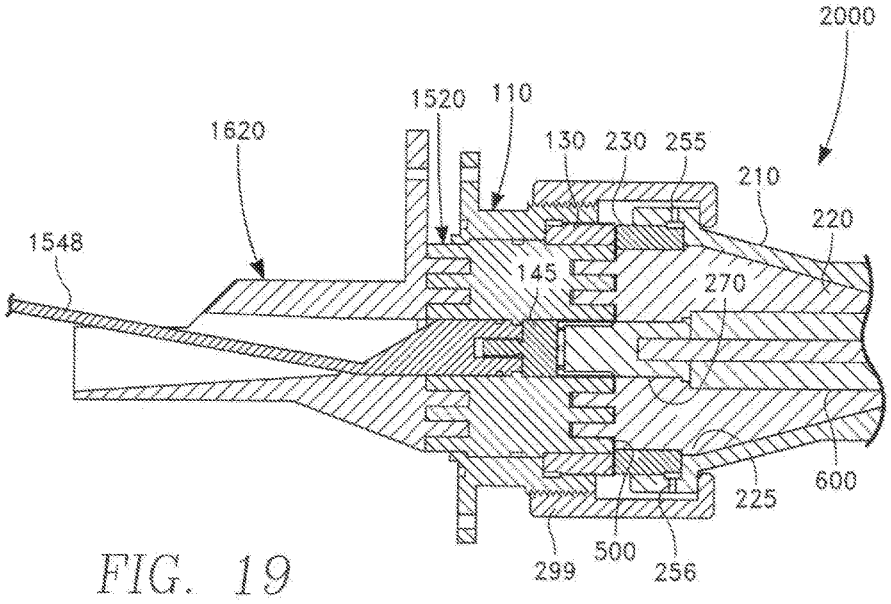
FIG. 19 is an illustration of a cross section view of another embodiment of the high voltage RF connector.
Figure 20:
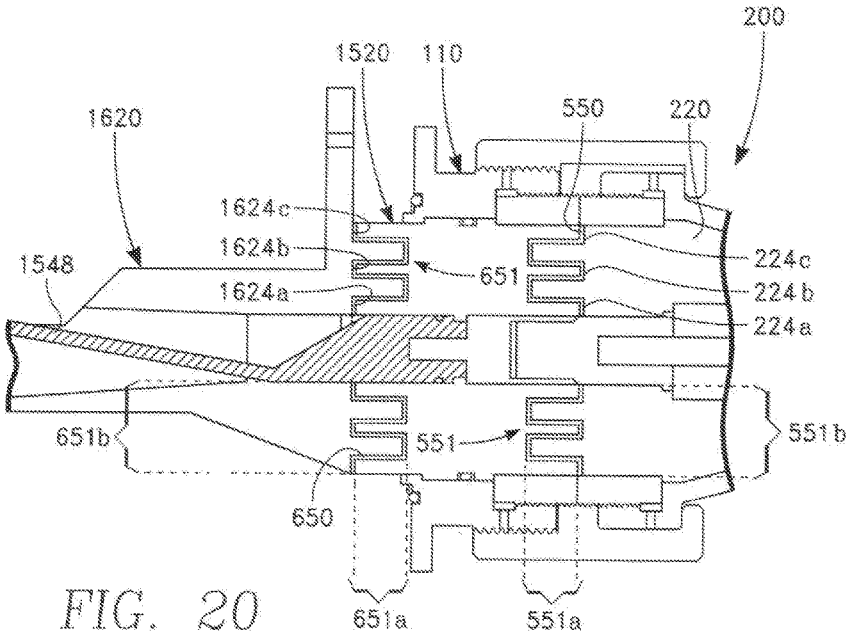
FIG. 20 depict a portion of another embodiment of the high voltage RF connector and shows a first air gap and second air gap, respectively

FIG. 19 is an illustration of an assembled, cross section view of another embodiment of the high voltage RF connector. As shown in FIG. 19, another embodiment of the high voltage RF connector 2000 may comprise a bulkhead connector 1500 and a coaxial cable connector 200. FIG. 20 shows that the bulkhead connector 1500 may mate and engage with the coaxial cable connector 200, such that the mating face 1524 of the first bulkhead connector dielectric insert 1520 may overlie the mating face 224 of the coaxial cable connector dielectric insert 220. In this manner, a first air gap 550 (shown in FIG. 20) may be formed in-between the first bulkhead connector dielectric insert 1520 and the coaxial cable connector dielectric insert 220 to thereby provide an impedance matching compensation. Importantly, the impedance of the first air gap 550 may be determined by a first air gap distance 551 based on: (1) a length between the inner and outer diameters of the first bulkhead connector dielectric insert 1520 and coaxial cable connector dielectric insert 220 and (2) depths of the two circular grooves 1524*a*, 1524*b* of the first bulkhead connector dielectric insert 1520 and circular grooves 224*a*, 224*b*, 224*c* of the coaxial cable connector dielectric insert 220.

Similarly, FIG. 19 shows that, within the bulkhead connector 1500, the first bulkhead connector dielectric insert 1520 may mate and engage with the second bulkhead connector dielectric insert 1620. In this manner, a second mating face 1724 (shown in FIG. 15C) of the first bulkhead connector dielectric insert 1520 may overlie the mating face 1624 the second bulkhead connector dielectric insert 1620. In this manner, another air gap 651 may be formed in-between the first bulkhead connector dielectric insert 1520 and the second bulkhead connector dielectric insert 1620 to also provide an impedance matching compensation. Importantly, the impedance of the air gap 651 may be determined by an air gap distance 651 based on: (1) a length between the inner and outer diameters of the first bulkhead connector dielectric insert 1520 and second bulkhead connector dielectric insert 1620 and (2) depths of the two circular grooves 1724*a*, 1724*b* of the first bulkhead connector dielectric insert 1520 and circular grooves 1624*a*, 1624*b* of the second bulkhead connector dielectric insert 1620. In a preferred embodiment, the air gap distance 651 of this air gap 650 is approximately the same length as the air gap distance 551 of the first air gap 550. Details of the first air gap 551 and second air gap 650 are described in more detail below.

In one embodiment, the center conductor 1540 of the bulkhead connector 1500 may have a diameter that is approximately ¾ inches. The stripline transition piece 1548 of the center conductor 1540 may also have an internal thread adapted to engage with the head 145. A neck portion 1549 of the stripline transition piece 1548 may also function as an intermediate annular recess for securing the center conductor 1540 within the first bulkhead connector dielectric insert 1520. Annular edges of the internal thread of the center conductor 1540 may also be rounded or filleted in order to help reduce voltage enhancement.

FIG. 20 depict a portion of another embodiment of the high voltage RF connector and shows a first air gap and second air gap, respectively. Specifically, FIG. 20 shows how the first air gap 550 is formed when the bulkhead connector 1500 and the coaxial cable connector 200 are mated together. FIG. 20 also shows how the second air gap 650 is formed when the first bulkhead connector dielectric insert 1520 and the second bulkhead connector dielectric insert 1520 are mated together.

In one exemplary embodiment, the high voltage RF connector 2000 may be capable of withstanding electric field strengths of about 200 kV (or 215.25 kV based on a nominal 75 volts/mils breakdown of air). Thus, a first air gap 550 is needed at the mating connection point between the first bulkhead connector dielectric insert 1520 and coaxial cable connector dielectric insert 220. Given that air breakdown generally occurs at 75 volts/mil, the first air gap 550 may have a minimum first air gap distance 551 of 2.87 inches to satisfy the 200 kV voltage standoff requirement (nominally 215.25 kV).

To help fulfill the minimum air gap distance of 2.87 inches, circular grooves 224*a*, 224*b*, 224*e* may be added onto the mating face 224 of the coaxial cable connector dielectric insert 220. The circular grooves 224*a*, 224*b*, 224*c* may help create a longer air path distance from the inner radius of the coaxial cable connector dielectric insert 220 (e.g., center conductor portion 405 of the coaxial cable 400) to the outer radius of the coaxial cable connector dielectric insert 220 (e.g., coaxial cable connector body 210) by creating horizontal travel distances 551*a* and vertical travel distances 551*b* on the mating faces 124, 224 of the bulkhead connector dielectric insert 120 and the coaxial cable connector dielectric insert 220. Thus, given that the three circular grooves 224*a*, 224*b*, 224*c* create four transition grooves in-between circular grooves 224*a* and 224*b* and in-between circular grooves 224*b*, 224*c*, a total horizontal travel distance of approximately 2 inches and a total vertical travel distance of approximately 0.87 inches may be created. As such, assuming that the dielectric breakdown in air is 75 volts/mil, the first air gap distance 551 may be approximately 2.87 inches, which may endure a voltage standoff of approximately 215.25 kV in open air.

Similarly, regarding the second air gap 650, circular grooves 1624*a*, 1624*b*, 1624*e* may be added onto the mating face 1624 of the second bulkhead connector dielectric insert 1620. The circular grooves 1624*a*, 1624*b*, 1624*c* may help create a longer air path distance from the inner radius of the second bulkhead connector dielectric insert 1620 (e.g., head 145 of the center conductor 1540) to the second bulkhead connector dielectric insert 1620 by creating horizontal travel distances 651*a* and vertical travel distances 651*b* on the mating faces 1624, 1724 of the first bulkhead connector dielectric insert 1520 and the second bulkhead connector dielectric insert 1620. Thus, given that the three circular grooves 1624*a*, 1624*b*, 1624*c* create four transition grooves in-between circular grooves 1624*a* and 1624*b* and in-between circular grooves 1624*b*, 1624*c*, a total horizontal travel distance of approximately 2 inches and a total vertical travel distance of approximately 0.87 inches may be created. As such, assuming that the dielectric breakdown in air is 75 volts/mil, the first air gap distance 651 may be approximately 2.87 inches, which may endure a voltage standoff of approximately 215.25 kV in open air.

The foregoing description of the embodiments of the high voltage RF connector for coaxial-to-stripline transition has been presented for the purposes of illustration and description. While multiple embodiments of the high voltage RF connector for coaxial-to-stripline transition are disclosed, other embodiments will become apparent to those skilled in the art from the above detailed description. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Although embodiments of the high voltage RF connector for coaxial-to-stripline transition are described in considerable detail, including references to certain versions thereof, other versions are possible such as, for example, orienting and/or attaching components in different fashion. Therefore, the spirit and scope of the appended claims should not be limited to the description of versions included herein.

Except as stated immediately above, nothing which has been stated or illustrated is intended or should be interpreted to cause a dedication of any component, step, feature, object, benefit, advantage, or equivalent to the public, regardless of whether it is or is not recited in the claims. The scope of protection is limited solely by the claims that now follow, and that scope is intended to be broad as is reasonably consistent with the language that is used in the claims. The scope of protection is also intended to be broad to encompass all structural and functional equivalents.

What is claimed as new and desired to be protected by Letters Patent is set forth in the appended claims:

1. A bulkhead connector for a coaxial-to-stripline transition, comprising:

a bulkhead connector body having a flanged end, a threaded end, and a generally cylindrical cavity; and a first bulkhead connector dielectric insert snugly fitted within said generally cylindrical cavity of said bulkhead connector body and having a first end, a second end, and an axial bore adapted to house a center conductor, said first and second ends comprising: first and second mating faces, respectively, each having at least two circular grooves concentrically disposed with said axial bore;

wherein said bulkhead connector is adapted to mate with a coaxial cable connector having a coaxial cable connector dielectric insert comprising: one or more circular grooves and an axial bore, all concentrically disposed; and wherein as said bulkhead connector matingly engages said coaxial cable connector, said first mating face of said first end of said first bulkhead connector dielectric insert at least partially overlies a mating face of said coaxial cable connector dielectric insert, thereby forming a first air gap therebetween, said first air gap having an impedance determined, at least in part, by a first air gap distance based on: (1) a length between said inner and outer diameters of said first bulkhead connector dielectric insert and (2) depths of said at least two first circular grooves of said first bulkhead connector dielectric insert and said one or more circular grooves of said coaxial cable connector.

2. The bulkhead connector, according to claim 1, further comprising:

a second bulkhead connector dielectric insert comprising: one or more circular grooves and an axial bore, all concentrically disposed with one another and adapted to engage with said second end of said first bulkhead dielectric insert;

wherein as said second bulkhead connector dielectric insert engages said second end of said first bulkhead connector dielectric insert, said second mating face of said first bulkhead connector dielectric insert at least partially overlies a mating face of said second bulkhead connector dielectric insert, thereby forming a second air gap therebetween; and wherein said second air gap has approximately the same air gap distance as said first air gap.

3. The bulkhead connector, according to claim 1, further comprising: a center conductor disposed within said axial bore of said first bulkhead connector dielectric insert, said center conductor comprising: a head and a stripline transition piece.

4. The bulkhead connector, according to claim 1, wherein said second bulkhead connector dielectric insert comprises a flanged upper portion and a tapered bottom portion.

5. The bulkhead connector, according to claim 1, wherein said at least two circular grooves of first and second mating faces of said first bulkhead connector dielectric insert are shaped substantially identical.

6. The bulkhead connector, according to claim 1, wherein said first bulkhead connector dielectric insert further comprises an annular protrusion located within a sidewall of said axial bore; and wherein said transition piece includes a threaded bore and a neck portion adapted to threadably couple with said head of said center conductor to form an intermediate annular recess engaged with said annular protrusion.

7. The bulkhead connector, according to claim 2, wherein said first and second air gap distances are each approximately 2.87 inches.

8. The bulkhead connector, according to claim 1, wherein said threaded end of said bulkhead connector body comprises outer threads adapted to threadably engage with inner threads of a mating connector ring of said coaxial cable connector to prevent relative movement of said bulkhead connector and said coaxial cable connector, thereby maintaining said first air gap between said first bulkhead connector dielectric insert and said coaxial cable connector dielectric insert.

9. A bulkhead connector for a coaxial-to-stripline transition, comprising:

a bulkhead connector body being generally cylindrical and having a flanged end, a threaded end, and a generally cylindrical cavity, said threaded end comprising outer threads and inner threads;

a first bulkhead connector dielectric insert snugly fitted within said generally cylindrical cavity of said bulkhead connector body and comprising: a first end, a second end, and an axial bore adapted to house a center conductor, said first and second ends comprising: first and second mating faces, respectively, each having at least two circular grooves concentrically disposed with said axial bore; and a center conductor disposed within said axial bore of said first bulkhead connector dielectric insert;

wherein said bulkhead connector is adapted to mate with a coaxial cable connector, comprising: (1) a coaxial cable connector dielectric insert having one or more circular grooves and an axial bore, all concentrically disposed with one another on a mating face of said coaxial cable connector dielectric insert; and (2) a center conductor plug disposed within said axial bore of said coaxial connector dielectric insert; and wherein as said bulkhead connector matingly engages said coaxial cable connector, said first mating face located on said first end of said first bulkhead connector dielectric insert at least partially overlies said mating face of said coaxial cable connector dielectric insert, thereby forming a first air gap therebetween, said first air gap having an impedance determined, at least in part, by a first air gap distance based on: (1) a length between said inner and outer diameters of said first bulkhead connector dielectric insert and (2) depths of said at least two circular grooves of said first bulkhead connector dielectric insert and said one or more circular grooves of said coaxial cable connector.

10. The bulkhead connector, according to claim 9, further comprising:

a second bulkhead connector dielectric insert comprising: one or more circular grooves and an axial bore concentrically disposed within said one or more circular grooves, said second bulkhead connector dielectric insert being adapted to engage with said second end of said first bulkhead dielectric insert;

wherein as said first bulkhead connector dielectric insert engages said second bulkhead connector dielectric insert, a second mating face of said first bulkhead connector dielectric insert at least partially overlies a mating face of said second bulkhead connector dielectric insert, thereby forming a second air gap therebetween; and wherein said second air gap has approximately the same air gap distance as said first air gap.

11. The bulkhead connector, according to claim 10, wherein said first air gap and said second air gap each have an air gap distance of approximately 2.87 inches.

12. The bulkhead connector, according to claim 11, further comprising: a center conductor disposed within said axial bore of said first bulkhead connector dielectric insert, said center conductor comprising: a head and a stripline transition piece; and wherein said stripline transition piece feeds to an antenna.

13. The bulkhead connector, according to claim 12, wherein said second bulkhead connector dielectric insert comprises an upper flanged portion and a bottom tapered portion.

14. The bulkhead connector, according to claim 13, wherein said first bulkhead connector dielectric insert further comprises an annular protrusion located within a sidewall of said axial bore; and wherein said transition piece includes a threaded bore and a neck portion adapted to threadably couple with said head of said center conductor to form an intermediate annular recess engaged with said annular protrusion.

15. The bulkhead connector, according to claim 14, wherein said at least two circular grooves of first and second mating faces of said first bulkhead connector dielectric insert are shaped substantially identical.

16. The bulkhead connector, according to claim 15, wherein said bulkhead connector further comprises a dielectric locking ring being generally cylindrical and having outer mating threads threadably engaged with said inner threads of said bulkhead connector body, said dielectric locking ring being adapted to abut against an annular shoulder of said first bulkhead connector dielectric insert, such that said first bulkhead connector dielectric insert is secured within said generally cylindrical cavity of said bulkhead connector body.

17. The bulkhead connector, according to claim 16, further comprising a mating connector ring adapted to contact and secure said coaxial cable connector and said bulkhead connector together to prevent relative movement and maintain said first air gap between said first bulkhead connector dielectric insert and said coaxial cable connector dielectric insert.

18. A bulkhead connector for a coaxial-to-stripline transition, comprising:

a bulkhead connector body being generally cylindrical and having a threaded end, a flanged end, and a generally cylindrical cavity, said threaded end comprising outer threads and inner threads and said flange end comprising an outer flange and an annular protrusion;

a first bulkhead connector dielectric insert snugly fitted within said generally cylindrical cavity of said bulkhead connector body and comprising: a first end, a second end, an axial bore, an annular shoulder contacting said annular protrusion of said bulkhead connector body, and an annular protrusion located within a sidewall of said axial bore, said first and second ends comprising: first and second mating faces, respectively, each having at least two circular grooves concentrically disposed with said axial bore and shaped substantially similar;

a second bulkhead connector dielectric insert comprising: one or more circular grooves located on a mating face of said second bulkhead connector dielectric insert and an axial bore concentrically disposed within said one or more circular grooves, said second bulkhead connector dielectric insert being adapted to engage with said second end of said first bulkhead dielectric insert;

a center conductor disposed within said axial bore of said bulkhead connector dielectric insert and comprising: a head and a stripline transition piece having a threaded bore and a neck portion, said neck portion being adapted to threadably couple with said head to form an intermediate annular recess engaged with said annular protrusion located within said sidewall of said second bulkhead connector dielectric insert; and a dielectric locking ring being generally cylindrical and having outer mating threads threadably engaged with said inner threads of said bulkhead connector body and an opening with a diameter fitted to allow said dielectric locking ring to abut against said at least one annular shoulder of said first bulkhead connector dielectric insert, such that said first bulkhead connector dielectric insert is secured within said generally cylindrical cavity of said bulkhead connector body;

wherein said bulkhead connector is adapted to mate with a coaxial cable connector for electrically coupling a high voltage coaxial cable to a stripline transition, said coaxial cable connector comprising:

a coaxial cable connector dielectric insert having: one or more circular grooves located on a mating face of said coaxial cable connector dielectric insert, an axial bore concentrically disposed within said one or more circular grooves of said coaxial cable connector dielectric insert, and an annular shoulder located on a sidewall of said axial bore;

a center conductor plug adapted to engage with said head of said center conductor and disposed inside said axial bore of said coaxial connector dielectric insert; and a mating connector ring adapted to secure and prevent relative movement of said bulkhead connector and said coaxial cable connector;

wherein as said bulkhead connector matingly engages said coaxial cable connector, said first mating face of said first bulkhead connector dielectric insert at least partially overlies said mating face of said coaxial cable connector dielectric insert, thereby forming a first air gap therebetween, said first air gap having an impedance determined, at least in part, by a first air gap distance based on: (1) a length between said inner and outer diameters of said first bulkhead connector dielectric insert and (2) depths of said at least two circular grooves of said first bulkhead connector dielectric insert and said one or more circular grooves of said coaxial cable connector; and wherein as said second bulkhead connector dielectric insert engages said first bulkhead connector dielectric insert, said second mating face of said first bulkhead connector dielectric insert at least partially overlies said mating face of said second bulkhead connector dielectric insert, thereby forming a second air gap therebetween, said second air gap having approximately the same air gap distance and shaped substantially identical as said first air gap.

19. The bulkhead connector, according to claim 18, wherein said second bulkhead connector dielectric insert comprises an upper flanged portion and a bottom tapered portion.

20. The bulkhead connector, according to claim 19, wherein said first and second air gaps each have an air gap distance of approximately 2.87 inches.

* * * * *